US010974111B2

(12) United States Patent
Rosamino

(10) Patent No.: US 10,974,111 B2
(45) Date of Patent: Apr. 13, 2021

(54) DEVICE AND METHOD FOR TEACHING/TRAINING GOLF

(71) Applicant: Nicolas Rosamino, Buenos Aires (AR)

(72) Inventor: Nicolas Rosamino, Buenos Aires (AR)

( * ) Notice: Subject to any disclaimer, the term of this patent is extended or adjusted under 35 U.S.C. 154(b) by 0 days.

(21) Appl. No.: 16/608,520

(22) PCT Filed: Apr. 25, 2018

(86) PCT No.: PCT/US2018/029358
§ 371 (c)(1),
(2) Date: Oct. 25, 2019

(87) PCT Pub. No.: WO2018/200672
PCT Pub. Date: Nov. 1, 2018

(65) Prior Publication Data

US 2020/0054925 A1 Feb. 20, 2020

(30) Foreign Application Priority Data

Apr. 26, 2017 (AR) ..... 20170101053

(51) Int. Cl.

| | |
|---|---|
| ***A63B 57/00*** | (2015.01) |
| ***A63B 69/36*** | (2006.01) |
| ***A63B 57/20*** | (2015.01) |
| *A63B 69/00* | (2006.01) |

(52) U.S. Cl.
CPC ..... *A63B 57/0006* (2013.01); *A63B 57/20* (2015.10); *A63B 69/3632* (2013.01); *A63B 69/0053* (2013.01); *A63B 2220/40* (2013.01); *A63B 2220/833* (2013.01); *A63B 2225/05* (2013.01); *A63B 2225/50* (2013.01)

(58) Field of Classification Search
CPC . A63B 57/0006; A63B 57/20; A63B 69/3632; A63B 69/0053; A63B 2220/40; A63B 2220/833; A63B 2225/05; A63B 2225/50; A63B 2220/17; A63B 60/16; A63B 69/3623
See application file for complete search history.

(56) References Cited

U.S. PATENT DOCUMENTS

| | | | | |
|---|---|---|---|---|
| 2,711,321 A | | 6/1955 | McGraw | |
| 3,778,067 A | | 12/1973 | Gentiluomo | |
| 4,355,811 A | | 10/1982 | Williams, Sr. | |
| 4,817,955 A | * | 4/1989 | Hickson | A63B 47/002 124/51.1 |
| 4,981,299 A | | 1/1991 | Petrillo | |

(Continued)

OTHER PUBLICATIONS

International Search Report dated Jun. 28, 2018, and dated Aug. 30, 2018, in connection with PCT International Application No. PCT/US2018/029358.

*Primary Examiner* — Steven B Wong
(74) *Attorney, Agent, or Firm* — Norris McLaughlin, P.A.

(57) ABSTRACT

A device and method of learning and training of the golf swing that is based on the performing of the swing as a continuous exercise, where the person, either a student in learning or a player in training, performs continuous movements or golf swings without depending on the presence of the ball on a ball placement site, in which the device places the ball on the ball placement site in a programmed or random way without making the person stop the succession of continuous swings.

10 Claims, 4 Drawing Sheets

(56) References Cited

U.S. PATENT DOCUMENTS 4,995,614 A * 2/1991 Tange ..... A63B 47/002 473/137
5,052,688 A * 10/1991 Shiau ..... A63B 47/024 473/135
5,071,131 A * 12/1991 Turnidge ..... A63B 47/002 473/137
5,282,629 A 2/1994 Eckstein
5,297,797 A * 3/1994 Lamontagne ..... A63B 57/0006 473/133
5,326,107 A * 7/1994 Park ..... A63B 57/0006 473/132
5,458,339 A * 10/1995 Wildes ..... A63B 57/0006 473/136
5,624,325 A 4/1997 Smith
5,647,805 A * 7/1997 Tarbox, Jr. ..... A63B 57/0006 473/132
5,685,782 A 11/1997 Lipps et al.
6,083,122 A * 7/2000 Brown ..... A63B 57/10 473/401
6,159,016 A 12/2000 Lubell et al.
6,159,105 A * 12/2000 Henry ..... A63B 57/0006 473/132
6,969,324 B1 11/2005 Staehs
7,344,446 B2 3/2008 Wyeth
7,959,525 B1 * 6/2011 Brown ..... A63B 57/0006 473/387
9,211,439 B1 12/2015 Pedenko et al.
2005/0239026 A1 10/2005 Suzuki et al.
2005/0282647 A1 12/2005 Staehs
2006/0252018 A1 11/2006 Sooch
2011/0276153 A1 11/2011 Selner
2015/0051020 A1 * 2/2015 Duncan ..... A63B 69/3623 473/396

* cited by examiner

DEVICE AND METHOD FOR TEACHING/TRAINING GOLF

BACKGROUND OF THE INVENTION

Field of the Invention

The present invention is related to the field of devices, artifacts and techniques used in the instruction, teaching and/or training of sports practices and, particularly, the invention is referred to a device and a method using such device for the instruction, teaching and/or training of golf. More specifically, the invention refers to the effective development of the movement or swing that a player must do to strike a golf ball correctly.

Description of the Prior Art

Before starting with the description of the devices and the known and used systems in this art for the instruction, teaching and training of the necessary movements for the strike of the ball in golf, it is convenient to refer to certain technical concepts that will help understand better the object and content of the invention.

There are a number of methods to teach the necessary movements to practice golf, and, particularly, the movement that is done to strike the ball called "golf swing" or simply "swing". The majority of these methods tends to teach the student the movement making the student repeat it to analyze that swing in such a way that it can be compared with excellence models, professional golf players swing images, computerized images, etcetera.

The Published Patent Application US 2011/0276153 A1 describes a method for teaching golf based on comparing a number of personal characteristics of a student with the personal characteristics of a group of high-performance golf players. Collected data is being used to determine golf players groups that share certain physical and swing characteristics based on real time measures. An orthodox swing is developed that will later be applied to the student, using Newtonian mechanics and biomechanics elements to measure the sensitivity of the ball's trajectory, and the precise performance, and thus determine a punctuation system to give a simple measure to the students in the state of their own changes with respect to the orthodox swing.

The Published Patent Application US 2006/0252018 A1 discloses a method of analyzing golf shots that uses a video camera to record video shots of a golfer and analyze their swing. The recorded video is first reduced in the minimum required time of useful data, which is divided in a number of frames and in a number of key places identified in each photogram. Then an analysis is done on the different aspects of the golf swing through the video, processing each corresponding frame. The user is provided with recommendations to correct the failures and can compare his/her changes with the ones done by professional golfers.

The Published Patent Application US 20050239026 A1 describes a method and an evaluation system of the golf swing that allows a clear visual comparison of an ideal swing model and the student's own swing in an image determining accurately the corresponding points to be improved.

The U.S. Pat. No. 6,159,016 discloses a system and method to produce a videotape of a personal golf lesson with a visual record of the student's swing and a videotape that includes a pre-recorded teaching lesson. The pre-recorded videotape has spaces in pre-determined places in which videos are inserted with a complete movement of the student's swing and still images are chosen. This allows images to be overlapped and make comparisons between the student's swing and the one belonging to the professional golfer.

As it can be seen, the existing methods tend to provide images comparing the student's swing with the professional golfers' swings or orthodox swings. In the case of a student, this means that the student resorts to external visual comparisons, that is to say, the student incorporates external visual images as a model, yet, the student is not taught or instructed from his/her interior concept of movement, particularly from his/her swing. The instruction is based on the acquisition of knowledge that goes through external visualization of a model but not through a kinesthetic perception of the correct movement. Moreover, there are countless devices, systems and artifacts used to help students in the training and learning of the golf swing. As it is known, the golf players and golf students that train and learn with professionals resort to different places to practice called "driving ranges" or practice ranges, where a series of lots and tees are provided and from where the players strike balls sending them off to a big field. These fields generally have distance measuring locations with flags and other indicative signals. In the tees the golfer can find a mat simulating grass of a real golf course from where they strike the ball, including a small rubber bearing called "tee" where the ball is put to be struck by a determined golf club, for example, the one called "driver". The balls are set by the student or player on the floor or on the tee manually. To make this task easier, many devices have been invented that dispose balls on the carpet or on the tee automatically or activated by the player so that he/she can strike without the need of bending over to get the ball and put it on the tee or the mat. Some of these devices of previous art of the invention will be referred to thereafter.

U.S. Pat. No. 2,711,321 discloses a device that discharges golf balls from a system that is located under the practice mat. The mat has a hole through which a tee is moved up and down. The balls are set one by one on this tee by a machine so that the player can strike it. In this way, the tee moves below the mat, the ball gets placed on the tee, and this tee comes up through the hole that is on the carpet for the player to strike. This mechanism, that has rods and articulated levers, is operated through a pedal by the player.

U.S. Pat. No. 5,282,629 discloses a similar device to the one previously mentioned, but the mechanism is formed by a cylinder and a pneumatic circuit that operate the coming down of the tee, the placement of the ball on the tee and the coming up of the tee with the ball in the position from where the golfer will strike it. It is an automatic mechanism and it works detecting the ball on the tee, that is, the detector detects if the tee is the in position to be struck and if a ball is on the tee. If there is no ball on the tee when the tee is in the position to be struck, it is determined that the ball has been struck and this generates the coming down of the tee to be loaded with the next ball.

U.S. Pat. No. 4,355,811 discloses a similar system to the previous ones, where there is a tee on which the system locates the ball to be struck and it is connected to a mechanism of mechanical activation located under the floor. When the ball is struck with the golf club, the tee is also struck and it bends under the action of the strike in such a way that one of the inferior extremes of the tee acts through a microchip that, in turn, generates the order to start the cycle of loading a new ball on the tee. The systems above mentioned are of a mechanical type and as such they can be guaranteed that they are useful for fixed installations in driving ranges but they can never be portable. There are, however, other systems that provide and load balls to be struck during the practice of the golf swing that can be fixed or portable whose mechanisms are at floor level. Subsequently, these systems and artifacts will be mentioned.

U.S. Pat. No. 4,981,299 discloses an automatic device to provide and position golf balls in a certain position to be struck. This device has a receptacle of balls, an oscillating wheel, a device to position balls and a tee where the ball is set. The oscillating wheel takes the ball from the receptacle to a discharging position on the ball positioner and goes back for another ball. The ball positioner has a reversible engine and a ball carrier for the back and forth movement between the position of grabbing the ball and the position of striking the ball placed on the tee. The tubular tee includes a photo sensor connected operatively to a drive engine and it is sensitive to light to indicate if there is a ball or not on the tee. That is to say, as soon as the player strikes and sends off the ball, the mechanism places a new ball.

U.S. Pat. No. 5,326,107 discloses a device that has a container of golf balls and a dispenser that includes a horizontal movable arm. The arm is covered by a casing in a retracted position and stocks golf balls over this arm. A guide wire holds the ball during the arm movement from the casing to the tee. When the arm is in its full extended position, it moves on the guide wire to free the ball on the tee. An engine drives the arm to move back and forth. The engine can be operated through a pedal to deliver the ball once the player has struck the one that is on the tee.

U.S. Pat. No. 6,969,324 describes a device to put golf balls automatically on a tee that has an extendible arm operated by the player to put the ball on the tee. Then, a sensor operates a controller to reverse an engine. In this way, the arm retracts completely so that the player can strike. The user can unleash a new cycle through the collocation of a golf club head in the surroundings of a sensor.

U.S. Pat. No. 5,624,325 describes a device that has a golf ball container and a pivoting or oscillating arm that grabs the balls of the container and puts them on a tee one at a time to be struck by the player. The pivoting arm can be activated by the golf club the player is using to move it from the position where the arm grabs a ball to the position where it puts it on the tee. When the arm is released, it goes back to free the zone where the player will strike the ball.

U.S. Pat. No. 7,344,446 describes a golf ball detector system to detect when the ball has been struck and removed from the tee where it rests.

It is clear that there are a great number of devices that provide and position golf balls on a tee to be struck by a player with a golf club. However, all these devices have been created with the only purpose of putting the ball in front of the player, either by voluntary activation of the player or by automatic activation when the ball has been struck and removed from the tee. There has not been any other motivation than that of facilitating the player's work to avoid bending to grab a ball to be put on the tee before striking.

If there is a desire to implement a learning-teaching method based on the development and acquisition of the golf swing through the use of the player's kinesthetic perceptions where the mandatory placement of a ball in front of the player represents an external factor that is inserted in the movement or continuous swing, none of the devices available today in the previous art could be useful for developing the players' inner game or inner game of the golf player.

For all the above mentioned, it is very convenient to count with a new learning method that develops the effective movement that a player does to strike a ball, in such a game as golf, and a device to facilitate such ball delivery without representing an external factor that alters the flowing feeling state in the fulfillment of the swing needed to perform a correct impact.

BRIEF DESCRIPTION OF THE INVENTION

It is therefore an object of the present invention to provide a new method and/or a new device that allows the player that is training and practicing the movement of striking a ball not to face deliberately such ball but that such ball appears programmed or randomly, in the place where it should be struck, automatically whether in the player's control or not.

It is also an object of the present invention to provide a new device and/or a new golf teaching method, especially for the development and acquisition of the swing in order to reduce and/or eliminate the negative influence that the ball, as an external agent, has on the player at the moment of performing the swing. This negative influence ends up contaminating and/or interfering with the sensation and/or feeling of a pure swing sensation and a high intensity swing sensation that the player experiences when he/she makes a practice swing concentrating only on performing the swing without a ball, thus, without the burden of having to strike the ball and shoot it along the correct trajectory.

It is even another object of the present invention to provide with a new device and/or method of instruction and training of the golf swing that is based on a groundbreaking, novel concept, called for this invention, continuous movement or exercise or drill, where the player, either as a student in a learning process or as a player in training, does a succession of continuous movements or golf swings without depending on the presence of the ball in a certain place for positioning or impacting of such a ball.

It is still another object of the present invention to provide a method for teaching and training the effective swing that a person must perform, being this person a student in learning or a player in training to strike a golf ball adequately to practice this sport, wherein the method comprises the steps of:

a) providing the person with a golf club with which the person will perform the movement or swing of golf, b) providing a device for supplying balls to strike, the device being capable of placing one ball at a time in a ball placement site, wherein the device comprises:

at least a control module that detects the movement of at least one of said person and said golf club, wherein the control module actuates said device to place such balls one at a time at said ball placement site, c) activating said device to make said at least one control module detect the movement of at least one of said person and golf club, d) making the person positioning in front of the device adopting a position to perform the movements or golf swings along a path that passes through said ball placement site, e) making the person performing movements or golf swings continuously, f) detecting, through said control module, the number of swings performed by the person, g) making said device positioning a first ball in said ball placement site when the number of swings done by the person is "n+1", and h) making said device continuing positioning a ball at a time in said ball placement site every "m" movements or swings done by the person.

Furthermore, it is also an object of this invention to provide a device for the instruction, teaching and/or training of the movement or swing to be performed by a person, being a student in learning or a player in training, to strike a golf ball adequately to practice this sport, where the student counts with a golf club with which he/she will perform the movement or golf swing, where the golf club has a head to strike the ball placed in an impact position or ball placement site and throw it to the desired target, and a grip to be held by the person's hands, and where the movement or golf swing comprises at least a backward movement where the golf club moves away from such desired target and a forward movement towards that desired target to strike the ball to that target, wherein the device comprises:

(i) at least an arm that holds balls and places them one at a time in such ball placement site, (ii) at least an impeller to move such arm and make it grab such balls and put them one at a time in such ball placement site, and (iii) at least one control module that detects movement of said at least one person and his/her golf club and activates such impeller to move said at least one arm so that it makes it grab such balls and places them one at a time in such ball placement site according to the detected movement.

Furthermore, it is an object of this invention, to provide a device for the instruction, teaching and/or training of the movement or swing that should be done by a student in learning process or a player in training to strike the golf ball adequately for the practice of this sport, where the person counts with a golf club with which will perform the movement or golf swing, where the golf club has a head to strike the ball that will be placed in a certain position to be struck and thrown to a desired target; and a grip to be held by the person's hands where the movement or golf swing involves at least a movement where the golf club moves away from the desired target and a coming back movement towards the desired target's way, to impact the ball and directing it to such desired target where the device involves:

(i) a ball container, (ii) at least an arm that grabs balls from such container and puts them one at a time on such ball placement site, (iii) at least a signal emitter disposed on either such person or such golf club, (iv) at least an impeller to move said at least one arm and make it grab balls from such container and put them one at a time on such ball placement site, and (v) at least a controlling module that detects the movement of said signal emitter disposed either on such person or such golf club that triggers such impeller to move said at least one arm to grab balls from such container and put them one at a time on such ball placement site according to the detected movement.

BRIEF DESCRIPTION OF THE DRAWINGS

For greater clarity and understanding of the device of the present invention, various drawings have been illustrated through which the invention has been graphically shown in one of the favorite ways of realization, all of which is done as an example, where:

FIGS. 1 and 2 show a player performing a swing with a golf club for long strokes, the method of the invention is not limited to this kind of golf clubs, it also applies to the short game golf clubs called "wedge" and "putter";

DETAILED DESCRIPTION OF THE INVENTION

With reference to the Figures and details of the invention, it can be seen that it is referred to a teaching method and/or instruction and/or practice of the effective movement to strike a ball correctly in the practice of a sport that requires an ordered movement called swing, this invention includes a useful device in order to put into practice such method of this invention. Even though all the detailed description is focused on the practice of the golf swing, it will be evident for any person instructed in sports that this method and device, the last one with some changes to be adapted, can be used for the instruction of the hockey swing, tennis swing, etcetera.

Firstly, it is important to refer to the method of the invention in order to better understand the concepts associated with the game, particularly, with the movement or golf swing.

The method of the present invention is based on the exercising of a movement or swing which, for the purposes of the present description will be named "continuous exercise" and it is carried out through the device, according to the invention as well, that it is an automatic device that detects the players' movement during the continuous exercise. The purpose of the exercise is to improve the golf swing that is integrated and synchronized with the method and the device of the invention.

The proposed continuous exercise of the present invention is that the player does a pre-fixed or random number of swings or movements to strike a ball. Three continuous swings are recommended so that during the first two, there is no ball in the ball placement site and then in the third swing the ball is placed to be struck. The device of the invention places the ball very quickly taking record of the number of the swings done by the player and according to this record, it enables the placement of the ball, which, in some cases, is unexpected by the player. That is to say, the player never stops the continuous swings. The player stands adopting the correct swing position called "stance", he/she puts the golf club, specifically the club head, on the striking site or ball placement site where the ball will be placed and from there the continuous swing movements start being executed without interruptions, constantly going through the same place of such striking site or ball placement site on the backward and forward movement or swing. It is preferable that during the first swing there should not be a ball to be struck, but after the first swing, the ball will be placed for the player in a certain or random manner. That is to say, the device can be programmed to place the ball on the tee or striking site every one swing, two swings or more. Of course, this can also be done randomly.

Figure 1:
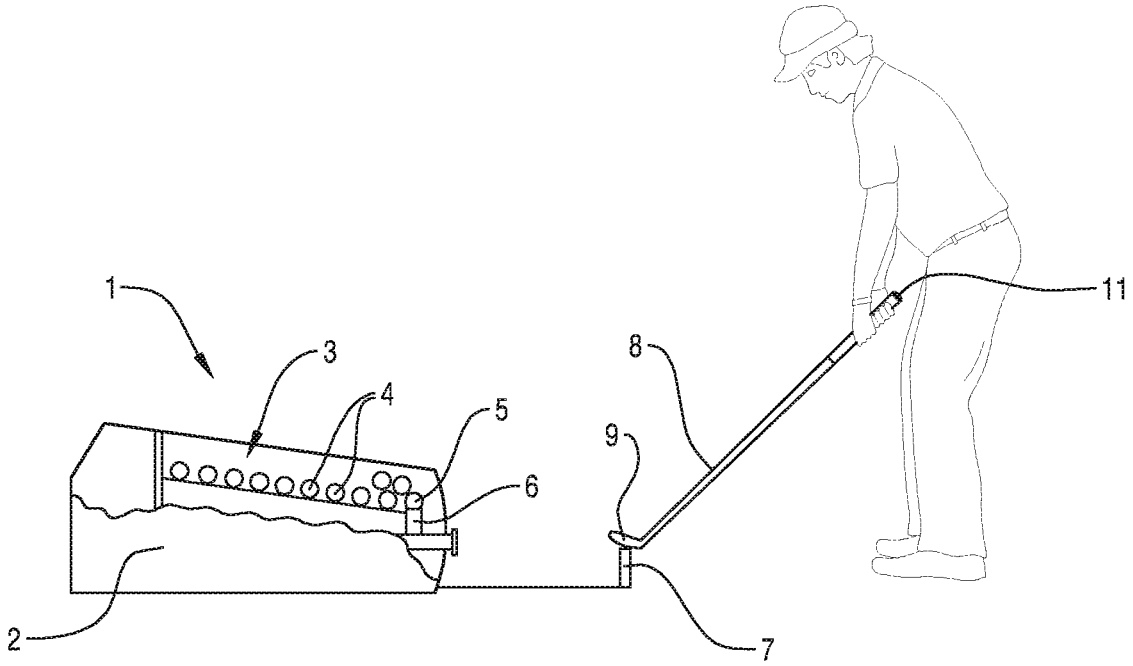
FIG. 1 shows a person, either a student or a player, adopting the "ready" position, also known in the golf jargon the position of "stance" and prepared to start the swing, where the stance is adopted in front of the device of the invention that is also shown in this illustration and/or FIG. 1.

In order to exemplify, it can be said in general terms, that a swing starts in the position seen in FIG. 1, then the player lifts the golf club upwards moving away from the target to which the ball will be directed to. This movement is called "backward movement"; then the golf club starts coming down towards the desired target where the player wants to direct the ball, consequently, towards the ball. This forward movement has a non-described length in the FIG. 1 in which the golf club ends above the player; this moment is called "finish" or ending of the swing. From this point, if the player continues performing swings, the movement will descend according to a backwards trajectory moving away from the desired target; it will go through the place where the ball has been placed to be struck or the ball placement site until it gets to the illustrated position shown in FIG. 2. In other words, the swing is composed of a backward and a forward movement of the golf club, where the backward movement is moving away from the direction of the desired target and the place where the ball rests waiting to be struck, and the forward movement is the golf club movement towards the desired target and the ball to be struck and thrown to the mentioned target. It must be clear that this golf movement, according to the method of this invention, is considered to strike the ball with any golf club; for example, this swing is applicable to be done with the golf club called "putter" and it is used to hit the ball towards the golf hole in the sector of the golf course called "Green".

According to the method and device of the invention, the player does the swing movements in front of the device continuously without interruption. That is to say, without stopping between swings. The purpose of this is to achieve an effective movement, that is to say, a sensitively purer one and intensively higher one. As it has been mentioned above, starting the practice, the first swing is done preferably without a ball on the tee or ball placement site. Then the balls will be placed according to a practice mode or pattern chosen by either the player or the teacher as a function of the device. In this way, a certain function can be chosen, where the relationship or ratio among the practice swings or swings without a ball and the delivery of the balls is established, where the ball is placed under a certain number of swings. For example, the ball placed every three swings, called for the purpose of this description ratio or relationship 3:1, as a result of which, two swings will be done without the ball and in the third one, the ball will appear, if the ratio is 2:1, the ball will appear every two swings; in the ratio 1:1 the ball will appear every swing, but always counted after the first ball has been placed in the ball placement site. Moreover, the random function can be chosen, where the player continues executing swings without interruptions and the ball is placed on the tee randomly and surprisingly for the player. The starting swing or swings, namely the first one, the second one and so on, done without a ball placed in the ball placement site, do not form part of the mode "ratio". Ratio must be understood as a relationship between swings with and without balls after the first ball is placed in the placement site.

The purpose of the method of the invention is that the player develops the motor and psychological fundamentals with the continuous exercise; for example, in a ratio 3:1 the purpose is to access, develop and acquire the motor and psychological fundamentals, from this point on, the player can go through the other functions to gradually approach striking the ball effectively with one swing, exercising in this way the same fundamentals. The player can also choose the quantity of swings to be done in each function. The functions as well as the quantity of swings collaborate to access and develop the motor and psychological fundamentals and gradually achieve more challenging objectives until such fundamentals can be applied when striking a ball with only one swing. This objective is the most challenging one.

To achieve this, after the Continuous Exercise in the ratio 3:1, the player goes to the ratio 2:1 and continues gradually in this way. As long as the player operates consciously or unconsciously from the "Kinesthetic-Swing Focus" and not from "Kinesthetic-Automated Swing Focus or Mode", "Visual-Ball Focus or Mode, and "Visual-Anticipated Result Focus or Mode", the player can get closer towards the following continuous exercise until the player gets to the final product of striking the ball effectively with one swing. All the recent terms mentioned will be explained in detail later.

When the player stands in front of the device and starts to perform swings, the device of the invention detects the number of swings thanks to the controllers and the sensor-transmitters for such purpose whose objective is to detect the movement of the golf club in space to distinguish in which trajectory or position of the golf swing the golf club is at. For example, when a student, starting from the ball placement site, even without the ball, the player moves the golf club backwards and forward to the site of impact as it was explained before, at least one module of the controller and detector and sensor-transmitter of the device detects the first swing. This can be detected thanks to the different positions that the golf club has been adopting in space or also to the number of times the golf club goes through the striking or impact place where the ball is.

When the system of the invention has detected that the golf club has done the first swing, it prepares the delivery and placement of the ball to be in the ball placement site to be struck for the following swing, in the second, in the third, in the fourth or at random swings, according to the function and quantity of swing chosen by the player. Although it is not a preferable function, the ball can also be placed in the first swing.

According to the method described, the player does not need to perform practice swings far away from a ball already set on the ground as it takes place nowadays during practice having to approach and adopt the stance or setup position when he/she decides to strike the ball. In fact, nowadays, according to the common practices, the player puts a ball in the ball placement site, distances himself/herself form the ball, performs one or two practice swings to acquire memory of the movement to be done, then the player approaches the ball, adopts the necessary position or stance to do the swing placing the golf club, specifically the club head, behind the ball and does the swing striking it. The player does only one swing with the ball with the purpose of improving the movement and the ball interferes strongly with the effectiveness of the movement because the player is conditioned and/or influenced negatively by the presence of the ball and this alters his/her swing involuntarily. It is clearly demonstrated that the practice swings before striking the ball are much nearer to the ideal and effective swing than the swing the player does once he/she stands in front of the ball to strike. The preparatory swings done without the commitment of having to strike the ball are highly effective. And according to studies and experiences of the inventor, these swings are kinesthetically purer and more intense than the definitive striking swing. Later in part "No 5 The Stroop Effect and the learning of golf", these concepts will be developed in detail.

The strike of the ball during the continuous exercise proposed by the invention avoids interrupting the fluency of the swing and, according to the experiences of this invention, the striking of the ball will achieve a genuine swing that is not affected by external factors or distractors such as the ball in front of the player before striking it.

The ratio 3:1, that is the one with the ball only in the third executed swing, i.e. two swings without ball and one swing with a ball; this is the favorite one since it is the most effective to achieve an excellent learning process of the functional motor and psychological fundamentals; this is very distant from what can be seen in the majority of amateur players nowadays in relation to these fundamentals. This ratio varies according to how much the player accesses the functional psychology needed to perform an effective swing. The higher the need to access to this functional psychology, the bigger the ratio is, for example, 3:1; and the lower the need to access, the smaller the ratio is, as in 1:1, because the player already accesses on his/her own.

In this way, the student or player does a specific number of swings, pre determined by the player and also determined by the degree of access to the functional motor and psychological fundamentals. According to the concepts of the invention developed by the inventor as it will be explained later, with this methodology of continuous exercise, the player improves the purity and the intensity of the swing based on the kinesthetic perception of the player without the presence of external factors such as the change of stance that takes place before striking the ball or as having to bend down to put a new ball in place; or the pressure and anxiety that a player experiences because of not having the motor and the psychological fundamentals to deal with the ball already placed and static for various seconds. According to this method of the invention, the player concentrates only on performing the swing and in his/hers own kinesthetic perception without paying attention to the ball and/or integrating it in a functional way that will appear at any determined or random moment.

The ball can be placed in the striking site preferably by a device according to the present invention whose details will be presented later on. The devices and artifacts of previous art used to place balls in the striking site, which have been referred to previously, in the state of the art of the invention, are not prepared or designed to put into practice the method of the invention. Some of the most evolved and known devices mentioned before can detect the presence of the ball in order to put a new ball on the tee or striking site once the player has already struck the ball placed beforehand. The only purpose of this is to prevent the player to bend down to get a ball from a basket of balls and place it on the tee. None of these devices register what the player is doing, that is to say, of the player's movements, and the devices that do register the player's movements is done with the only purpose of acquiring data or movement data and/or to make comparisons of such movement with the ideal swing movements taken from professional players.

To try to apply the present method of "Continuous Exercise" using these known devices will be a failure because such devices will always put a ball immediately after the previous ball has been struck; so the player that wants to perform continuous swings without a ball should have to dodge the ball already placed by the device in the striking place. That is to say, the player should alter the swing movement by making the golf club get out of the striking trajectory. It is important to insist on stating that these known devices place a ball immediately after the previous ball has been struck. Consequently, if the student learns with the method of the invention, he/she has already struck the ball and a new cycle of movement starts. For example, in a cycle of three swings, during the first two swings, the student should not strike the ball that has already been placed by the device. In order not to strike the ball during those two first swings, the student must pass the golf club outside or above the striking place to avoid hitting the ball, performing in this way an incorrect movement due to the coming off of the swing plane. This plane corresponds to an optimum trajectory through which the golf club should move. In that case, the player should be directing, manipulating and consciously controlling the golf club through a wrong place in order not to strike the ball during the first two swings, instead of letting it flow and surrender to the natural movement. To perform such natural movement, the player or student should go through the striking place but he/she cannot because there is a ball placed by the device; and also it is highly unsafe for whoever is on the opposite side of the desired target. The greatest limitation of directing, manipulating and consciously controlling the golf club, besides unnecessary tensions, makes the player stay in a comforting zone or very close to such zone, hindering the player to achieve a better technique or swing.

To understand even more clearly the concepts of the invention, that is, the continuous exercise and the automatic device here proposed, it is convenient to take into account some of the theoretical fundamentals of the practice of golf and its relationship with the invention.

1) Motor fundamentals of golf.

2) Psychological fundamentals of golf.

3) Difference between the traditional methods and the Continuous Exercise.

4) In each swing of the Continuous Exercise, the player consciously goes beyond the present movement.

5) The "Stroop Effect" and the learning of golf.

1) Motor Fundamentals of Golf

The method of the invention, in a groundbreaking, innovative way, integrates the continuous exercise together with the motor and psychological fundamentals. Through the concepts of the invention, the implicit skill of the professional golf players becomes explicit. Just like the majority of the experts on any subject, "they do what they know" but not necessarily "know what they do". This is precisely what the inventor has decoded and has made it explicit. Such explicit knowledge is the motor and psychological fundamentals. The inventor, besides having identified the implicit knowledge of the professional players, has also done the same with the average amateur golfers. So, there is a functional motor and psychological pattern and a dysfunctional one.

The motor fundamentals and/or essential skills of the professional players are the "pure swing sensation or feeling" or "pure swinging sensation or feeling" and an "intense swing sensation or feeling" or "intense swinging sensation or feeling". For the purpose of this description, these skills can be called "sensitive or kinesthetic fundamentals". In other words, when such players perform the swing, they perceive kinesthetically a "pure swing sensation" and an "intense swing sensation" or "high intensity swing sensation". In average amateur golfers, the motor fundamentals are "impure swing sensation" and/or "hit sensation" and a "low intensity swing sensation". In other words, such players by doing a swing perceive kinesthetically a sensation of an impure swing and a sensation of a reduced or low intensity swing.

The sensitive or kinesthetic qualities of these motor fundamentals are: "purity" and "intensity". Such sensitive qualities are the same for the professional players as for the average amateur golfers, the difference lies on the degree of performance of each of them.

With the explicit motor fundamentals, the player knows what to do and what to perceive and/or detect as an improvement reference. The player also knows what not to do and what to perceive and/or detect as a non-improvement reference. These references serve as feedback and evaluation indicators. This method articulates the functional motor fundamentals and the dysfunctional ones, that is to say, what to apply and what not to. There are sensitive and/or kinesthetic patterns and habits that bring out effective results and there are ones that do not. It is important to state that the purpose of any method, no matter what the discipline is, is to develop the fundamentals of such discipline. Besides, when the amateur players undergo through involuntary and universal behaviors that harm the effective performance of the swing, then two issues are relevant to talk about the fundamentals: the fundamentals to move towards a behavior and the fundamentals to move away from a behavior. So, there are fundamentals to go to a desired behavior and fundamentals that move away from the desired behavior. The important issue about this is to know that such fundamentals are kinesthetic sensations, implicit and unconscious sensations. When these sensations become conscious, that means, articulated and explicit, they are called kinesthetic perceptions. So, from now on, they are called kinesthetic perceptions.

The focus and emphasis here is on the sensations, since the technique and the sensations are two sides of the same coin. If the technique is altered, consequently, the sensations also alter and vice versa. The method of the invention is focused and works on the kinesthetic perception (conscious and articulated sensations) to achieve the desired technique. The major advantage to work with the kinesthetic perception is that it uses a more effective and quicker road or way to get to the desired technique.

The professional players performing consistently an effective swing have a pure swing sensation and a high intense swing sensation. These sensations that the player perceives kinesthetically when performing the swing are objectively measured registering and recording the movement of the body together with the golf club. Objectively, the "purity" is evaluated and measured through the quality of the acceleration of the movement, considering the body together with the golf club, and the "intensity" is evaluated and measured through the quality of the acceleration of the movement together with the velocity or quantity of movement of the body together with the golf club. The amateur players during a practice swing, without having to strike a ball, also feel these motor fundamentals but in contrast with the professional players, is that the amateur players have a sensation of an impure swing sensation and a reduced intensity swing sensation when they have to execute a swing to strike a ball, or they can also perform a high intensity swing sensation but with an impure swing sensation. The quality of the motor fundamentals, purity and intensity, are the same for a professional as for an amateur; what changes is the degree of such quality that each player moves. If the purity and intensity were shown in a Cartesian graphic, the intensity would be on the positive coordinate axis and the purity would be on the abscissa axis. The impure ones would be on the negative side of the abscissa axis and the pure ones on the positive side of the abscissa axis. It can be drawn countless curves that combine both parameters.

In the instruction and training according to the method and device of the invention, the amateur player does on each swing a purer and higher intensity one. Through the kinesthetic perception and applying the continuous exercise, the player continuously perceives and registers where the purity and intensity are and makes the necessary adjustments, consciously or unconsciously, to increase the purity and the intensity. The pure swinging sensation and the high intense swinging sensation that the professional players experience are skills that the amateur golfer applying the Continuous Exercise start to develop from the very first moment. That is why this is the most effective exercise or drill in golf. The player, with this method, constantly perceives the golf club as an extension of his/her body. Being this a very powerful sensation for the player because only professional players or advanced players can feel. When applying the "continuous exercise", that is, using this method, the player achieves it from the very first moment independently of his/her level of the game.

These motor fundamentals are primary sensations and they consist of a kinesthetic pattern being these ones the most relevant grouping of the secondary sensations. This grouping is known as chunking, that is why the functional motor fundamentals are so effective when used. In other terms, the ability to perform a good swing is composed of sub-abilities, pure swinging sensation and an intense swinging sensation. Then, the player, through implementing the "continuous exercise" develops the essential kinesthetic abilities. Once these essential abilities are developed, the player goes to the golf course, faces the ball and transfers such abilities by performing only one swing with the ball. This is an intuitive and holistic method. This is a method where the right hemisphere of the brain is the predominant one during the swing. The right hemisphere is the one that should dominate to perform the swing with ball on the golf course. The way to develop and transfer this to the golf course is not through the conventional methods. It is necessary that the player should be in continuous movement and let the ball face or approach him/her in the right moment; in this way, such player learns from his/her natural and innate abilities. That is to say, with the method of this invention, the amateur player learns effectively and rapidly to turn from an impure swing to a pure one and to turn from a sensation reduced in intensity to a high one.

2). Psychological Fundamentals of Golf

What follows will put in evidence what limits the average golfer psychologically at the moment of striking a ball. There are three dysfunctional psychological fundamentals that the amateur player repeats involuntarily and operates from them. In this way the player limits himself/herself to improve the swing. Applying the Continuous Exercise, according to the teachings of the invention, the player does not operate from these dysfunctional fundamentals but from the functional ones, specifically "Kinesthetic-Swing Focus".

As with the motor fundamentals or the essential motor abilities, the professional players have also developed and possess psychological fundamentals. When a professional golfer performs a shot on the golf course towards a target, the swing is an effective one since it adapts to the present need. In order to develop such an effective swing, the player must have "Swing Intention" and in this way, the player has operated psychologically from "Kinesthetic-Swing Focus".

This is precisely, apart from being the starting point, what every amateur player must access to improve and transform his/her swing performance. The fundamental "Swing Intention Kinesthetic-Swing Focus" is the first functional psychological fundamental to automate and this automation simplifies the development of the rest of the functional fundamentals and this is achieved with the "Continuous Exercise" of the invention.

Shortly, the seven intentions that a player can have when striking a ball will be presented. An intention can be evaluated and measured objectively through the technique that the player displays or exhibits. In other words, according to the intention that the player has, a specific technique will become evident. In this section, the difference between "Swing Intention or Swinging Intention" and "Hit Intention or Hitting Intention" will be highlighted since they are opposite intentions.

Every intention in this section is the desire and order to achieve or do something specific. That is to say, it is the emotional desire and the order or mental command to achieve or do something specific. In the mental command, the behavior is implicit.

There are two states to operate psychologically: the first state is "Focus" and the second state is "Mode". The first one is conscious and the second one is unconscious. The second state is developed by a lot of repetitions of a stimulus operating from the first state. The focus state develops the mode state but mode state does not develop the focus state.

"Focus" is the attention and/or concentration directed to achieve or do something specific during the swing or strike. The Focus is a way of operating psychologically and it always directs to only one of the variables that intervenes during the swing with ball, for example, the swing to be performed, the contact to make, etcetera. The focus, besides directing and/or attending to only one variable, uses and integrates a sensitive modality more than others; this means a sense more than other senses.

The player's focus heads to a variable to be achieved or done together with its respective sense. This is the resulting expression of how the player operates psychologically through the intention the player has had.

"Mode" is the automatic activation of a specific cognitive structure during the strike. In other words, it is a specific automatic neurophysiologic circuit already developed and automated during the swing with ball. The "Mode" always integrates one or more of the intervening variables during the swing together with its respective senses. For example, if the player's "focus" is on the result to achieve, being this "Kinesthetic-Result Focus", the player will operate automatically from the "Kinesthetic-Contact Mode" and "Kinesthetic-Swing Mode". These two last fundamentals are necessary for the player to get the desired result since in the sequence to execute the strike; first the player must perform the swing and the necessary contact.

"Kinesthetic" or "Sensitive", modality or sense, consists of being connected or associated to the sensations and/or kinesthetic perceptions.

The "Swing" consists of being aware and/or associated to the movement the player wants to achieve or perform, not only to improve it but also to transfer it. When speaking about achieving and/or improving, it is meant to do something new, while speaking about transferring, it is referred to something that the player has and wishes to recreate in another context or scenario, for example, transfer it to the golf course.

The "Contact" consists of being aware and/or associated to the contact that the player wants to achieve or perform either to improve it or to transfer it.

The "Result" consists of being aware and/or associated with the result that the player wants to get, either to improve it or to transfer it.

The "Target" consists of being aware and/or associated with the target that the player wants to get, either to improve it or to transfer it.

The psychological fundamentals are classified in functional and dysfunctional ones. If the desire is to improve the swing, the functional fundamentals that must be encouraged to operate from is "Kinesthetic-Swing Focus".

The amateur player, when applying the continuous exercise, focuses on the first state, that is to say, "Kinesthetic-Swing Focus" and then, with constant practice, the player develops the second state, the functional cognitive structure (the neurophysiologic circuit) one: the "Kinesthetic-Swing Mode".

The amateur player, when performing a stroke with a ball, often operates psychologically from the opposite polarity of the professional, being this one the "Visual-Ball Focus".

The terms Focus and Mode have previously been described.

The "Visual", modality or sense consists of being aware and/or associated to what it is being seen.

The "Automated Swing" consists of being connected and/or associated to the automated movement that the player already has or wants to transfer or recreate.

The "Ball" consists of being connected or associated to the ball, which the player wants to strike.

The "Anticipated Result" consists of being connected and/or associated externally with the future result of the ball during the movement before striking.

In both "Focus" and "Mode", the variable and the sense are here together and linked: "Sense-Variable Focus" because they interact and strengthen each other. As an example: "Kinesthetic-Swing Focus".

Here again there are two states and the player must avoid operating from the following dysfunctional fundamentals: "Kinesthetic-Automated Swing Focus and Mode", "Visual-Ball Focus and Mode" and "Visual-Anticipated Result Focus and Mode". As it has already been mentioned, the Focus is integrated in the Mode.

Consequently, the professional players are operating from the point "Kinesthetic-Swing Focus and Mode", while the amateur players are on the other side: "Visual-Ball Focus and Mode".

The inventor, as well as with the motor fundamentals, codifies and makes it explicit the psychological fundamentals of golf: the intention that the player has together with the way he/she operates psychologically. Here, the functional psychological fundamentals are presented and set apart from the dysfunctional ones.

The functional psychological fundamentals must be encouraged to operate from them. Thereafter, these fundamentals are presented according to their order of execution:

1. Swing Intention Kinesthetic-Swing Focus
2. Contact Intention Kinesthetic-Contact Focus
3. Result Intention Kinesthetic-Result Focus
4. Target Intention Kinesthetic-Target Focus The dysfunctional psychological fundamentals must be avoided so that not to operate from them. They are presented in the following order:

5. Automated Swing Intention Kinesthetic-Automated Swing Focus
6. Hit Intention Visual-Ball Focus 7. Anticipated Result Intention Visual-Anticipated Result focus The player, when having a determined intention, he/she operates psychologically from the focus with its corresponding variable and sense. And, if the player operates psychologically from a certain focus with its corresponding variable and sense, the player will have the intention corresponding to such focus.

In this section in order to clarify, when presenting synthetically the "Swing Intention" or the "Kinesthetic-Swing Focus" are abbreviations of the complete fundamentals of "Swing Intention Kinesthetic-Swing Focus", and so with the rest of the fundamentals.

The intentions during the strike are for:

When having "Swing Intention", the player desires, orders and acts to achieve and/or perform a specific swing desired.

When having "Contact Intention", the player desires, orders and acts to achieve and perform a specific contact desired.

When having "Result Intention", the player desires, orders and acts to achieve and/or perform a specific result desired.

When having "Target Intention", the player desires, orders and acts to achieve and/or perform a specific target desired.

When having "Automated Swing Intention", the player desires, orders and acts to perform an automated swing.

When having "Hit Intention", the player desires, orders and acts to hit directly at the ball.

When having "Anticipated Result Intention", the player desires, orders and acts to anticipate the result of the ball.

Response-Movement and Reaction-Movement:

The player, when striking the ball and operating deliberately from the functional psychological fundamentals, performs a response-movement, that is to say, performs a conscious and voluntary behavior. In such strike, the player operates from the focus state; and in the sequence of execution, the player operates automatically—from the mode state—with the previous functional psychological fundamentals.

On the other hand, the player when striking the ball and operating involuntarily from the dysfunctional psychological fundamentals, performs a reaction-movement, that is to say, an unconscious behavior. In such a stroke, the player operates from the focus state, and, if the player has the neurophysiologic circuit developed of that behavior, then the player will operate from such mode state.

As a result, the response-movement is a functional fundamental operating from the focus state and the previous functional fundamentals; in the sequence of execution, the player operates automatically from the mode state. As regards the reaction-movement, it is a dysfunctional fundamental operating in Focus and/or Mode.

Conscious intention and Unconscious Desire and/or Intention:

Independently of the psychological trend that is chosen, all of them share non-conscious and/or unconscious desires that order the behavior to command an action to be done. When speaking about an involuntary or unconscious intention, it can be also called "desire". For example, "hit or hitting intention" can also be called "hit or hitting desire".

The "Intention" and/or "Desire" and/or "Focus" can be voluntarily or involuntarily. Despite the fact that the player may be aware and/or have the knowledge of the dysfunctional psychological fundamentals, he/she may operate involuntarily from there. This takes place because his/her focus involuntarily is directed to that dysfunctional fundamental. Evidently, if the player does not have the knowledge of what is effective and what is not effective for his/her game, the player may voluntarily execute the dysfunctional intentions.

The player can change the intention involuntarily during the stroke:

As it has already been mentioned, according to the intention that the player has, a specific technique will manifest or display. Moreover, when the average player desires to improve the swing, it is very common to see that the player starts the swing having a "Swing Intention" and, then, before striking the ball, the player has a "Hit Intention". That is to say, the player changes the intention involuntarily during the swing. This is one of the main and biggest reasons why the amateur players do not improve like they may. This also takes place with the "Automated Swing Intention" and the "Anticipated Result Intention". The source of all new behavior lies in the intention. That is why, to access and stay in the functional intention during the entire swing, in this case "Swing Intention", is the most relevant psychological and/or cognitive skill that a golfer can have. As it has been said, if the average golfer intention is changed during the swing, the technique will be altered resulting generally in a weak one, that is to say, in a kinesthetically "impure swing sensation". Such amateur's movement pattern is a by product and/or a result of operating cognitively from the dysfunctional fundamentals. This is the reason why the most important psychological aspect is to have and achieve a functional intention during the entire swing in order for the player to get what he/she wants. This is very hard to get with the traditional methods because every dysfunctional psychological fundamental is strongly at play in each strike since the swing is not a continuous one. So, the mind and/or the psychology of the player is directed to the dysfunctional intentions, which may have their origin in the past, present and future.

When having an "Automated Swing Intention", the player is attached to what he/she has developed or generated in the "past" when practicing. It is a developed habit, an automated movement, which represents security for the player, staying in his/her comfort zone together with his/her familiar sensations and/or movements. This is highly limiting to develop something new and also it never adapts to the present shot needed on the course.

When having "Hit Intention", the player is associated or attached to the ball; besides looking at it fixedly, the ball is always "present". This intention results in a huge psychological interference generated by an inner conflict and an order of striking the ball. This is why the "Hit Intention" is highly limiting and it can be said to be the opposite intention to the "Swing Intention".

Lastly, when having "Anticipated Result Intention", the player is associated or attached in advance with the future result of the ball before striking. Here, the player is literally thinking in the future; consequently, the player is not in the present moment with what he/she really has to do to have a good performance. Again, these three dysfunctional fundamentals are the ones that should be avoided. The "Swing Intention" should be encouraged and stimulated since the player achieves the desired swing, which simplifies the development of the rest of the functional fundamentals.

It is worth noting the difference between "Kinesthetic-Automated Swing Focus" and "Kinesthetic-Swing Focus". In the first one, the player stays in the comfort zone and in the second one, that is, when it is automatic operating through Mode, the player adapts to the present need of acting in accordance to the following intention and/or focus of the execution sequence.

The psychological fundamental to be developed is "Kinesthetic-Swing Focus" until it becomes to "Kinesthetic-Swing Mode". In this way, the player does automatically a pure and intense swing sensation.

Whereas, the "Automated Swing Intention Kinesthetic-Automated Swing Focus", "Hit Intention Visual-Ball Focus" and "Anticipated Result Intention Visual-Anticipated Result Focus" usually generate an impure and reduced in intensity swing sensation on the average player.

The continuous exercise makes the player's focus be connected with his/her sensations and swing, and it constantly encourages and directs each swing towards a purer and more intense one. Unconsciously or consciously, the player goes beyond his/her present level with each swing. This issue will be described in detail in the point No 4: "In each swing of the Continuous Exercise, the player consciously goes beyond the present movement".

Summing up, the continuous exercise is put into practice with the method and device of the invention used in the practice zone. With the invention, the player develops the fundamentals of a pure swing sensation, an intense swing sensation and, specially, the player achieves a "Kinesthetic-Swing Focus". In this way, with a lot of repetition of the same stimulus, the "Kinesthetic-Swing Mode" is consolidated. Consequently, the player develops and transfers an effective swing to the golf course.

3). Difference Between the Traditional Methods and the Continuous Exercise.

The player that practices sports with a ball such as tennis and golf should face or approach the ball, one in movement and another one static, and he/she must strike the ball correctly to head it with power and precision towards a desired place. Although golf is played facing the ball and striking it with one swing, this does not mean that it must be learned in this way to develop the fundamentals of golf. It must be learnt with the most effective method that develops those fundamentals. Between the static position that the player adopts, and the dynamic movement that the player does, the difficult issue has always been the development of the movement. Up to now, this has been developed by facing the ball and then striking it with one swing. Since the inventor has made the psychological and motor fundamentals explicit, the traditional methods do not consider nor do they make use of them consciously. In the instruction and methods known up to now, the technical aspect has prevailed over the kinesthetic one, in other words, the subjective sensitive aspect has been mainly ignored. So, traditionally, the emphasis has always been in the technical aspect and not in the kinesthetic one. The kinesthetic or sensitive aspect has not only been in a secondary place, but it also has adopted secondary sensations and not primary ones, being this relevant to improve. The lack of the device and the method "continuous exercise" developed by the inventor would hinder the development and the maximization of the functional motor and psychological fundamentals in the instruction and learning of golf.

Applying the traditional method, facing or approaching the ball and then striking it, the amateur player generally takes years to develop a good swing. Due to this fact the amateur player operates mentally from the dysfunctional psychological fundamentals. As a result, the player not only develops an ineffective swing from the beginning but also he/she finds it hard to unlearn it. Considering for a moment, the different aspects and levels that determine the swing, psychological, physical and sensitive or technical, the psychological one has the highest influence over the other two. Consequently, to operate psychologically from the dysfunctional intentions makes the amateur player perform, in general terms, a flawed or weak swing. Besides, it should be taken into account that the ball is present in each strike from the very first moment the player is introduced to the game and starts practicing it. And if the "continuous exercise" is not applied, the player will have "Hit Intention". In this way, the player has been developing an ineffective swing from the very beginning, instead of an effective one; that is to say, an impure swing sensation or hit sensation instead of a pure swing sensation. These are opposite technical movements. It is well known that in the golf world, the ball exercises a psychological interference and this triggers or unleashes a flawed movement. The ball exercises a strong and incongruent stimulus on the player, thereby a strong dysfunctional effect in the movement. However, the ball is necessary to the learning process and it must be integrated to perform the swing. The traditional methods do not make up for this incongruent and strong stimulus of the ball; this makes the learning process a conflicting one for the player. The ball is "an external visual stimulus that induces an internal conflict." This reduces and limits significantly the possibility of performing an effective swing. The inducing internal conflict is the fact of "having to hit the ball" instead of "performing a swing through the ball". Of the three dysfunctional psychological fundamentals, the ball, together with the stimulus that it generates, is always "present" in the strike; while the other two dysfunctional fundamentals are due to the development of the automated swing and the anticipation of a future result of the ball. As the strong incongruent stimulus generated by the ball cannot be counteracted by the traditional methods, they encourage and stimulate, not on purpose, the "Hit or Hitting Intention", activating, strengthening and consolidating the cognitive structure (neurophysiologic circuit) "Visual-Ball Mode". All of this is very ineffective for the player to perform functionally on a golf course. That is why, the process that experiences the amateur player to improve is truly complex, frustrating and slow. The majority of players do not improve as they want and others, unfortunately, get stuck rapidly.

When performing the continuous exercise, the learning process does not require an intellectual understanding from the player, because it does not require gnosis but it requires praxis. When applying or doing the continuous exercise, the motor and psychological learning process takes places. In other words, objectively doing the continuous exercise, the player develops motor and psychologically what he/she requires to play well. This is a brain-compatible learning process, a term from neuroscience—neurolearning—which is used to indicate that the method is aligned with the way the brain learns universally. The internal stimulus that the player receives when doing the continuous exercise, of going for a purer and more intense swing sensation, is stronger than the external stimulus of the ball; here, the player's success lies on the revelation why the continuous exercise is so powerful and effective. The continuous exercise self-stimulates and self-drives the player to consistently perform in each swing: a purer and more intense swing sensation than the previous one. Each swing the player does, preferably three for those who are distant from operating from the motor and psychological functional fundamentals, removes the player from the present comfort zone making each time a purer and more intense swing than the previous one. This means that the player does a consistently better technical swing than the previous one. So, each swing is more effective, either consciously or unconsciously, because the player in each swing desires, orders and performs a purer and more intense swing. This does not take place with the traditional exercises and methods, since a re-learning and/or a re-education is implied and this is more difficult than learning it from the beginning.

The amateur player finds it hard to improve with the traditional methods since the player's concentration must be higher than the stimulus exercised by the ball. The player who achieves a good swing by applying the traditional method does it, not necessarily because of the method used, but by the high concentration that the player has. In other words, it is the player's high concentration of what he/she wants to achieve in his/her swing that makes it possible to disconnect from the "ball" that he/she sees static on the floor, and from the imaginary and anticipatory "anticipated result" and from the flawed "automated swing" that he/she generally does. In this way, the player achieves to access for the first time to the new and desired movement. As this movement is repeated, the flawed movement is weakened. The repetition of the new stimulus is crucial to automate the new movement or desired swing. When the player is concentrated, he/she operates psychologically from "Kinesthetic-Swing Focus", and with a sustained practice in time, the player achieves the "Kinesthetic-Swing Mode". The challenge that the average amateur player faces each time he/she practices, is to be able to disconnect completely from the dysfunctional psychological fundamentals and to stay connected the "Swing Intention" during the entire swing. Because of this, there are few players with a low handicap—indicator of a good game level- and a lot of players with a high handicap—indicator of poor game level.

With the continuous exercise, the player operates from "Kinesthetic-Swing Focus" and starts developing an effective "Kinesthetic-Swing Mode" from the first moment; so the player re learns the movement achieving a technically strong swing, that is to say, sensitively purer and higher in intensity. This is extremely useful for both, the beginners and the amateur players that already play. The continuous exercise is not dependent on the concentration to improve; by contrast, the traditional methods do depend on the player's concentration to do so. As the continuous exercise is brain-compatible, the player improves the swing without having to depend on his/her concentration since the player's unconscious orders and commands to go for a purer and more intense swing each time.

When the average player performs a practice swing without the ball, he/she does a strong swing on a technical level, that is, a pure and intense swing sensation. This means that the average player already has a technically good swing but without the ball. The difficulty here is when, this same player with the simple act of facing or approaching the ball, turns to operate from the dysfunctional psychological fundamentals. Particularly from the "Visual-Ball Focus" and so, the player does a weak swing on a technical level. That is a kinesthetic impure and reduced intensity swing sensation. This makes the player have a very low level feedback of his involuntary movements. As the player operates from "Visual-Ball Focus", he/she does not know of his/her involuntary movements; that is, the player "does not know that he/she does not know", so the player continues doing the same thing trying to improve. Every feedback is meant to improve the following swing, and, as the player does not feel authentically and emotionally that he/she has to change—because the player does not register in the body the involuntary and flawed movements-, he/she does not do so. Thus, as the player does not register the involuntary or flawed movements he/she keeps doing them. And although the player takes lessons and applies the traditional methods, the player will depend on his/her concentration to achieve a strong technical swing. The traditional methods will make the student improve a lot of movements, however, the amateur players will be very far from having a technically strong swing with the ball, as the one done by the professional players or even done by them—amateur players—without the ball. The biggest problem of this issue is that the player will be far away from applying a technically strong swing to the golf course. As it has already been mentioned, to achieve this with the ball by the traditional methods, the player depends on his/her concentration and it requires a long time to get to this result. With the continuous exercise, according to the invention, every player gets to that result rapidly if he/she applies this method. It may be possible that the ball may interfere initially with the player's dynamic when performing the continuous exercise. If this takes place, the positive effect is that the player notices it strongly and immediately. That is to say, the player receives this feedback rapidly because he/she perceives it, and then, with the next ball, the player does the necessary adjustments focusing more on his/her kinesthetic perceptions performing, in this way, a purer and more intense swing. At the slightest psychological error or deviation towards "Kinesthetic-Automated Swing Focus" and/or "Visual-Ball Focus" and/or "Visual-Anticipated Result Focus", the player feels this through the body perceiving the involuntary movements. In the first two swings of the continuous exercise, the player operates, without exception, psychologically from "Kinesthetic-Swing Focus" consciously or unconsciously. In the third swing with the ball, if any involuntary movement takes place, the player easily detects this and he/she takes it into consideration for the next ball. With such psychology in mind, during the three swings the player strongly registers his/her body behavior, whether voluntary or involuntary movements.

On the other hand, with the traditional methods, the stimulus and kinesthetic intensity the player experiences is low and the visual stimulus is high. From the dynamic point of view, the swing time is of short duration, being it of approximately 1.5 seconds. In other words, this means that with the traditional methods, the static aspect is more encouraged or stimulated than the dynamics. This last issue is exactly the opposite of what the amateur players need.

Applying the continuous exercise, for example, the three swings, the stimulus and kinesthetic intensity that the player feels are very high, because of the long time duration on the dynamic level, being of approximately 5 seconds in continuous swings. In other words, the continuous exercise delivers a high kinesthetic and dynamic stimulus, giving exactly what the amateur players needs to consolidate an effective swing.

Summing up, being the continuous exercise brain-compatible defines the powerfulness and effectiveness of the method. The player learns effectively, rapidly and unconsciously because he/she operates from "Kinesthetic-Swing Focus", thus, is automatically going beyond the current movement with a high level of dynamic stimulus. For the learning process to be more effective and faster, the player should operate consciously from "Kinesthetic-Swing Focus". That is to say, in each swing of the continuous exercise, the player should voluntarily go beyond the current movement, and not just involuntarily. This is analyzed as follows.

4. In Each Swing of the Continuous Exercise, the Player Goes Consciously Beyond the Current Movement.

In each swing of the continuous exercise, the player goes beyond the current level unconsciously, that is to say, involuntarily.

As an example, performing the continuous exercise, what the majority of the players experience from their kinesthetic perception is a first swing of purity and intensity of 90%, in the second swing one of 100% and in the third swing one of an approximately 110%. This increase is done involuntarily, meaning unconsciously. This is because the method is, not only brain-compatible but also because the internal stimulus of going towards a purer swing sensation and a more intense swing sensation is stronger than the external stimulus of the ball. The player, doing the continuous exercise automatically, goes beyond the current and/or previous movement involuntarily. In each swing of the continuous exercise, the player goes towards a purer and more intense swing sensation than the previous one. This means that the swing is always purer and more intense than the previous swing. In this way, the player exhibits externally a better technical swing than the previous one. So, the player uses involuntarily the motor fundamentals in each swing of the continuous exercise to achieve a technically better swing.

The above mentioned can also be implemented consciously or deliberately. The best way to develop a skill or ability consists of breaking the skill down into small chunks or sub-abilities or fundamentals and, applying this, to practice and go beyond the current level, that is to say, getting out from the comfort zone.

This is exactly what the player does when practicing the continuous exercise. The player determines that he or she desires to have a good swing (ability), the small pieces (sub-abilities or chunks), in this case, they are the pure swing sensation and an intense swing sensation. Hence, the player goes beyond the current level in each swing of the exercise.

Here, the player operates from "Kinesthetic-Swing Focus" and he/she uses the purity and intensity consciously to go beyond the current movement voluntarily. For example, according to rehearsals done by the inventor, while performing the continuous exercise and going beyond the current movement consciously instead of unconsciously, the majority of the players experiences, from their kinesthetic perception, that in the first swing, they perform a pure and intense swing of approximately 100%, in the second swing, 110% approximately and in the third one, approximately 120%.

Through the continuous exercise, the player consciously achieves getting out of the comfort zone even more towards a better swing. In other words, applying the continuous exercise consciously, the comfort zone is expanded to its maximum potential to the functional or strong technical extreme, that is to say, to a high quality extreme and high quantity speed extreme of movement. The player, in this way and in each swing, goes to such technical extreme. When the player consciously exercises and stimulates a better movement, and operates from a functional psychology with ball that is from the psychology "Kinesthetic-Swing Focus", he/she acquires a more abrupt, definitive and transferable swing to the golf course. The player develops the fundamentals in the practice zone with the continuous exercise. Then the player goes to the golf course, faces the ball and transfers a similar ability done in practice performing only one swing with the ball. In other words, the player in the golf course applies a pure and intense swing sensation with the ball. The cognitive process applied consciously by the player is highly similar in both the practice and in the golf course, besides being strongly beneficial.

The player transfers the ability to perform an effective swing to the golf course; besides, developing the motor fundamentals he/she has developed a functional psychology to operate from when striking the ball with just one swing. This is achieved due to the way the player practices the continuous exercise, stretching out of the current movement, voluntarily or involuntarily, in each swing to a purer and more intense swing sensation with the ball. The internal stimulus of doing it purer and more intense is stronger than the external stimulus of the ball. That is why, the player accesses to an effective swing and this is achieved by the use of the method of continuous exercise of the invention.

5). "Stroop Effect" and the Learning of Golf.

As it has already been mentioned, with the traditional methods, the dysfunctional psychological fundamentals come into play.

One of the three dysfunctional psychological fundamentals will be described here in more detail, the one that most affects and limits the amateur player: "Hit Intention Visual-Ball Focus". Of the three fundamentals, the ball is the one that most undermines the amateur player because it is always present.

With the traditional methods as already mentioned, the ball generates an internal conflict in the player interfering with the desired motor learning process. To understand such conflict accurately and the psychological challenges involved, it is necessary to go beyond the game of golf.

The "Stroop Effect" is a scientific psychological test that evaluates the interference that takes place in the time of reaction of a certain task. For example, there is a test where the word "red" is written in "green" ink color and the person has to say, as soon as possible, the color that the person sees instead of the written word. In a combination of several written colored words of different ink colors, without coinciding the written colored word with the ink color, generates an internal conflict; hence, it produces an increase in the reaction time, and therefor it contributes to making mistakes. In other words, the person takes more time to answer "green" and, possibly, the person makes a mistake and says "red". Here, the word "red" written in "green" ink is considered an incongruent stimulus. By contrast, if the word "red" is written in red color, the stimulus is considered congruent. Lastly, when all the words are written in black ink, the stimulus is considered neutral.

This scientific test, apart from the classical "Stroop Effect", has other differences or fluctuations as for example "Warped Words Stroop Effect", "Emotional Stroop Effect", "Spatial Stroop Effect", "Numerical Stroop Effect", and "Reverse Stroop Effect". The "Stroop Effect" in golf is manifested as a motor pattern. The golf player that has not yet developed the motor and psychological fundamentals experiences a similar process to the "Stroop Effect" each time he/she has to strike the ball. This is the main factor that limits the learning process of an effective swing. The method of the continuous exercise proposed by the inventor accomplishes to polarize and disable this ineffective process.

In golf, the neutral stimulus is when the player performs a practice swing without the ball. The incongruent stimulus is activated and technically appreciated (weak technique) when the amateur player performs an only swing with ball. By contrast, the congruent stimulus is activated and technically appreciated (strong technique) when applying the continuous exercise method of the invention.

In order to evaluate these three types of stimuli in each player that has not yet developed the fundamentals, the inventor has observed the manifested technique in each of these three tasks:

1. Performing only one swing without ball. This is a swing without stimulus.

2. Performing only one swing with ball. This is a swing with an external incongruent stimulus (the ball) towards an effective movement.

3. Performing the continuous exercise. This is a swing with a congruent internal stimulus towards the desired movement; that is to say, going to a purer and more intense swing on each swing.

In other words, the first one is the manifested technique that the player already has when performing a practice swing without ball. The second one is the manifested technique when performing a swing in an interference situation (external incongruent stimulus) generated by the ball. The third one is the manifested technique when performing the continuous exercise (internal congruent stimulus).

In practice, the technical pattern of the practice swing and the swing with continuous exercise are similar and they also differentiate clearly from the technical pattern of the swing with ball. Furthermore, between the practice swing and the one with continuous exercise, the technical pattern with the continuous exercise is clearly more effective in performing a purer and more intense swing. To prove this, technical parameters have been measured and registered, as for example the butt end of the grip of the golf club, seen from front of the player or face on view, together with the club head of the golf club at the impact, and the speed of the golf head through the impact zone. As it has already been mentioned, with the continuous exercise the player performs an effective swing, similar to the one being performed without ball, but this time integrating the ball, being this vital for an effective learning process.

Then, in face of an internal conflict that the player experiences, the player does not access to an effective movement; consequently, he/she does not automate the desired movement. This is what is needed to develop an effective swing and transfer it to the golf course.

With the continuous exercise here proposed, the player accesses to the desired movement through the strong internal sensitive or kinesthetic stimulus excluding all, or close to all, external factors. In this way, and with repetition, the effective swing is automated.

The continuous exercise achieves something that never has been achieved: that the internal sensitive or kinesthetic stimulus (purity and intensity) is greater than the external visual stimulus (the ball); this removes totally, or almost totally, the ball interference.

That is to say, with the continuous exercise, there is no internal conflict within the player since the player accesses consistently to his/her functional cognitive processes to develop the desired movement. The player accesses and stays during the entire swing in "Swing Intention".

According to the invention, the method can be used to teach and/or train an effective movement or swing that a player or student must perform to strike the golf ball properly to practice this sport. The method comprises the following stages or phases:

a) provide the player with a golf club with which the player will perform the movement or golf swing, b) provide a device that supplies balls to strike, being able to dispose of a ball each time in the ball placement site, where the device comprises:

(i) at least one control module that detects the movement of at least one of such player and such golf club and that it activates such device to place the balls one at a time in such ball placement site;

c) activate such device to make said at least one control module detect the movement at least one of such player and of such golf club, d) make the player place in front of such device adopting a position to perform the movements or golf swings along a trajectory that goes through such ball placement site, e) make the player perform movements or golf swing in a continuous way, f) detect through such controlling module the number of such player's swings;

g) make such device position a first ball in such ball placement site when the number of swings performed by the player is "n+1", and h) make such device continue positioning a ball each time in such ball placement site every "m" movements or swings.

As it will be described later, the device may comprise:

(i) a ball container or holder, (ii) at least an arm that takes balls from such holder and puts them one at a time in such ball placement site, (iii) at least a signal transmitter disposed in either such player or such golf club, (iv) at least a driver, actuator or impeller to move said at least one arm and making it take the balls of from such holder and place them one at a time in such ball placement site, and (v) at least one control module that detects the movement of said at least one signal emitter or transmitter, and to activate such impeller to move such a least an arm to take balls from such holder and place them one at a time in such ball placement site, so with this device, the stages g) and h) of the method, as it has been described above, comprises:

g) make said at least one arm position the first ball in said ball placement site when the number of swings performed by the player is "n+1", and h) make said at least one arm continue positioning a ball at a time in such ball placement site every "m" movements or swings done by the player.

In the practice of the invention of the method, it is preferable that the first swing done by the player should be without placing any ball in the impact site or ball placement site. In this case, "n" will be 0 and the ball will be placed to be ready for the impact once the player has done "n+1" swings, that is 0+1, that is 1 swing. So, when the device detects that 1 swing has been performed, only then the ball is placed to be ready when the player does the second swing.

It has been said above that in order to start the training or teaching is more convenient to separate the placement of the balls allowing the player to perform swings without balls. For example, if the "n" value is 1, the ball will be placed once it has been detected that the player has done n+1 swings, that is, two swings. Hence, the ball will be placed to be struck in the third swing.

Even though it is preferable that "n" would be at least 0, to perform the first swing without ball in the impact place, it is intended that the ball may be placed in the impact site to be struck by the player in the first swing. The total quantity of swings to be done in a practice o learning cycle can be determined by the player or instructor if the player is a student. The quantity of swings is not a limiting parameter for the present invention.

Once the cycle of continuous swings is initiated, the balls can continue being placed according to the "m" variable. If "m" is 1, then the ball is placed for each continuous swing in such a way that the player strikes one ball for each of his/her swing. The balls can also be placed one every two swings, one every three swings, etcetera. For these cases, "m" will be 2,3, etcetera. As it will be seen when the device of the invention is described, it will be adjusted according to the function that the player or teacher desires.

The values "n" and "m" can adopt random numbers so that the player or student does not know when the ball is placed. After the player develops and acquires the "Kinesthetic-Swing Focus" with the ratio 3:1, preferably the random function is the next step. Applying the fundamentals that the player has all ready developed in this next step challenge with the ball, serves for acquiring the fundamentals even stronger towards a definitive swing with ball. The player's job is to keep on doing what he/she did with the previous function, which is operating psychologically from "Kinesthetic-Swing Focus" by keeping the purity equally as high, and this so on with the ratios remaining, 2:1 and 1:1.

This ball placement site can be a high support tee of the ball or simply a point on the ground where the ball lies.

It is very important to highlight that the player or student is always in the same place with his/her feet without moving from the position, doing or performing the swings continuously, passing through the site where the ball will be struck, in the backward movements as well as in the forward ones.

Here, the ball approaches the player that does the swings without getting out of the plane, succeeding in making the movement be more effective and efficient. This is notably different from some practices that some players do where several balls are aligned in front of the player and the players go walking and striking the balls one to one along the line of balls. In this case, different from the previous one, the player approaches the ball. The players that perform this last practice pursue other objectives, and besides, they have the ability already developed, that is, they already have the motor and psychological functional fundamentals. This can be appreciated in the movement since, once the motor and psychological functional fundamentals have been developed, the player can face tasks of high complexity and coordination, and be able to perform them successfully, differently from the players that have not yet developed such fundamentals.

As regards another aspect of the invention, a new device or supply system of balls to be struck is provided, being able to dispose a ball at a time in a ball placement site or site or point of impact site according to different functions, and, preferably but not exclusively, to put into practice the method of the invention.

Figure 3:
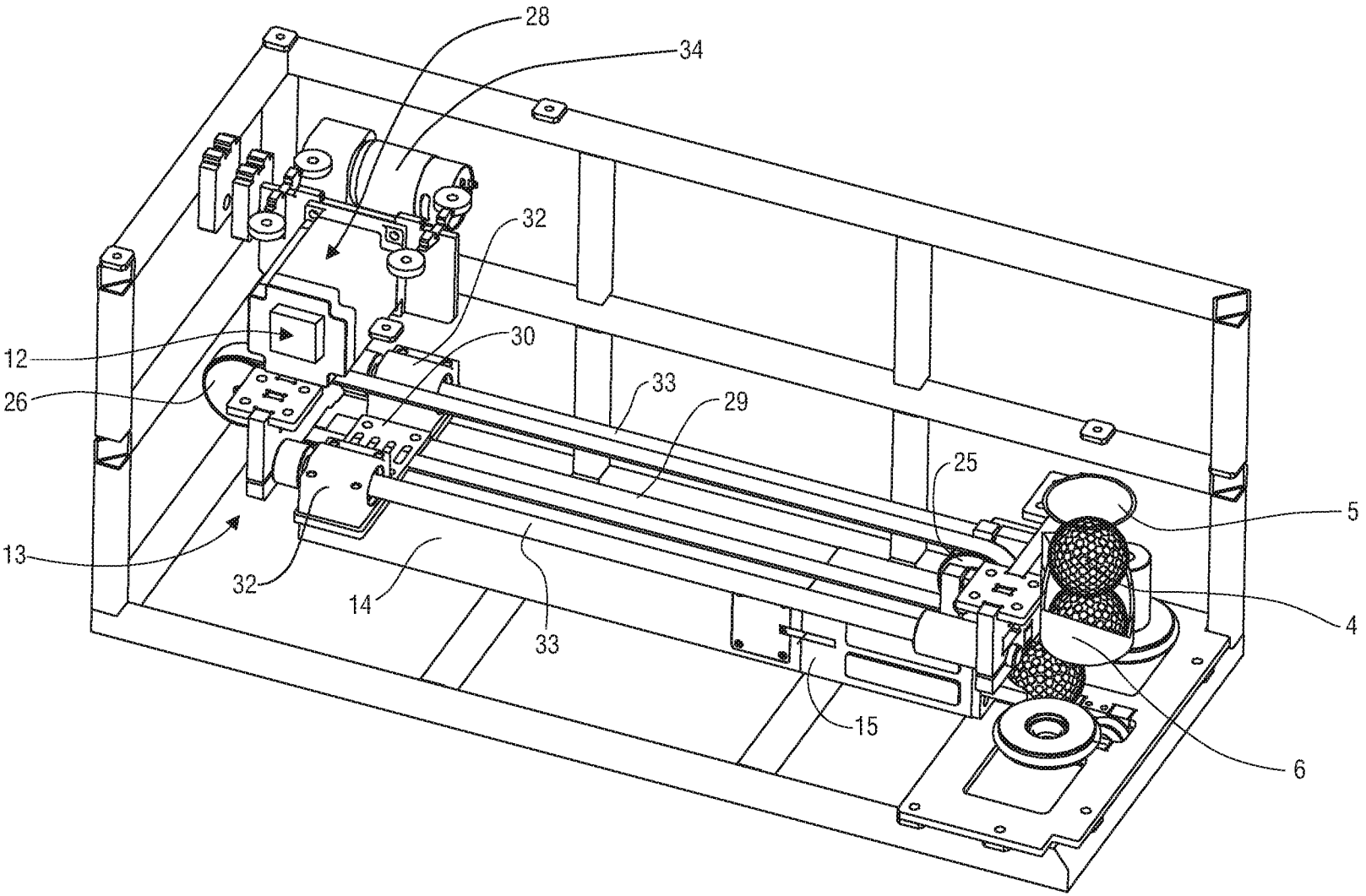
FIG. 3 shows a perspective view in partial section of the device of the invention, where the casing or housing has been removed to be able to see the internal components and mechanisms.
Figure 4:
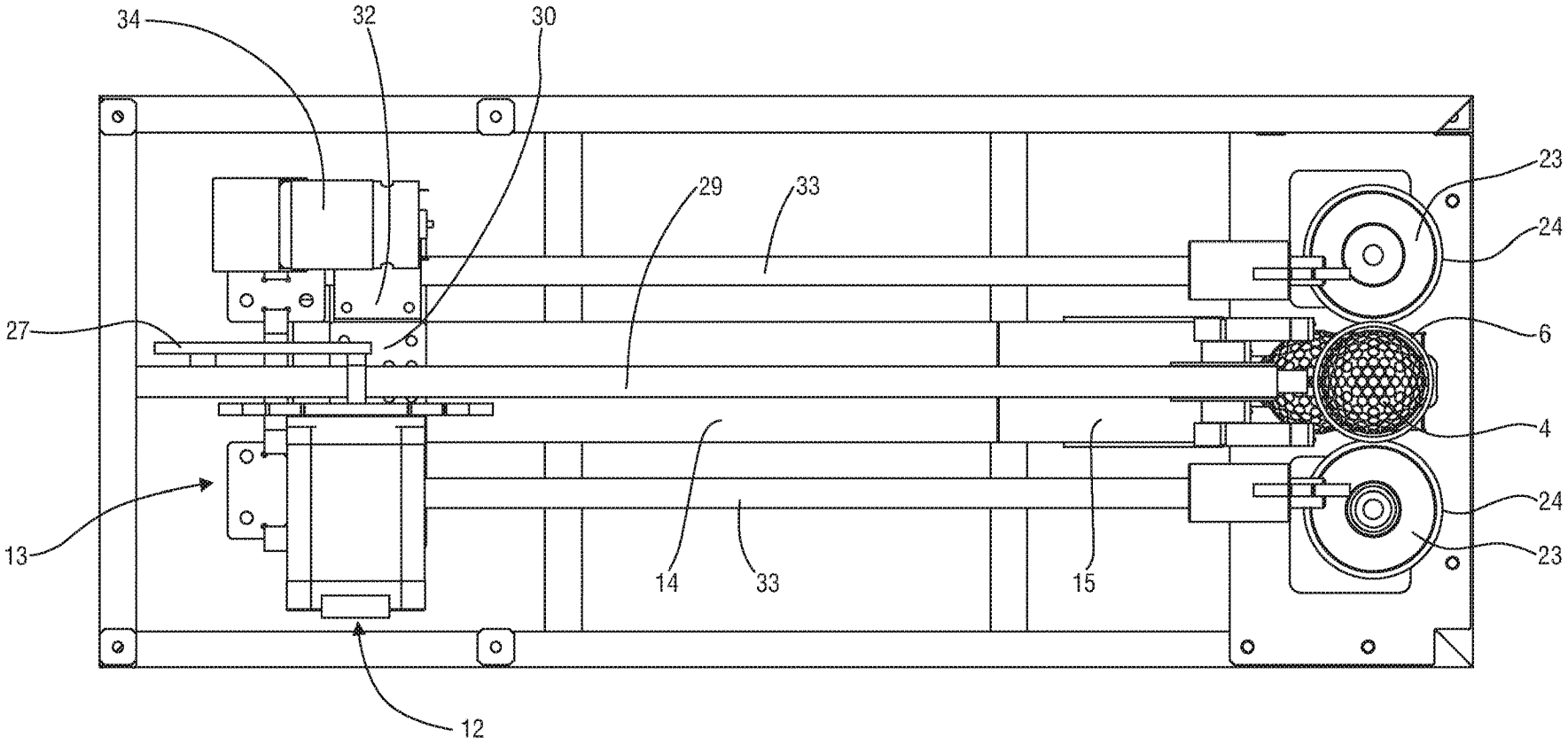
FIG. 4 shows a plant view of the device of the invention, without the casing as well.

In the FIG. 1, the device of the invention is shown in partial section together with a player prepared to start his/her swing standing in front of the device. The device or ball supplier of the invention, indicated by general reference 1, comprises a case or housing 2 that confines the functional mechanisms and components of the device. The case or housing 2 is partially removed to visualize the ball container or holder 3 inside of which a number of balls 4 are held, the holder or container has a configuration that favors the drop of balls towards a discharge or release exit 5 from a discharging tube of balls 6. Exit 5 and tube 6 are partially shown in FIG. 3, and tube 6 can be seen in plant around golf ball 4, in the FIG. 4. As it will be explained later, the tube will drop a ball at a time in a supplier mechanism of balls that will be described in detail.

At the beginning of the practice and according to the method already described above, the player stands in front of device 1 and adopts the position or stance to perform the movements or swings meant to strike the ball that will be placed in the ball placement or impact site as it is shown with reference 7, and, in the case of FIG. 1 and FIG. 2 that will be described presently, it is composed by a high support of the ball known as "tee", but it is clear that the placement site of ball 7 may be directly on the ground where the ball can be placed. As a remarkable difference with other known devices that place balls, it must be mentioned that the player stands directly in the position from where the player will strike the ball and from there on, the player will perform all the swings without moving from that position. With the known devices, the player adopts that position once the ball has been placed by the device, and after striking the ball, the player must move backwards if he/she wants to do a practice swing but the player, by no means, can go on performing continuous swings from that initial position because he/she will impact either the ball towards the opposite direction from the desired target and/or the arm that places the ball because that arm moves independently from the player's movement.

As it has been described with reference to the method of the invention, the player can perform a first swing without a ball being placed on tee 7. A complete swing starts from a the position shown in FIG. 1, where the player extends golf club 8 that has a head 9 to strike the ball in such a way that head 9 is placed in point of impact or very near of it. From there, the arms are moved upwards, in which has been described as backward movement, up to top of the backward movement, as shown in FIG. 2. From that position, the top of the backward movement, the golf club starts coming down along a descending curved trajectory to the point of impact or impact site 7 and to the target where the ball wants to be directed; this is generally known as downswing or forward movement. In that first swing, as it has been said, the head of the golf club will go through, in its plane trajectory of swing, by point 7 without striking any ball because device 1, according to its selected function, has not positioned a ball in tee 7. After going through tee 7 in its movement towards the target, the golf club goes up to the end position of the swing, which is called "finish". This, in a conventional practice, is where the movement or swing ends and the player takes a step backwards, in order to do one or more practice swings until a new ball is placed on tee 7 and there, the player does a new swing to strike the ball. But, according to the invention, the player does not take a step backwards distancing from the device, he/she stays in the same place and, once the golf club reaches the end position (finish) of the swing, it comes back descending through the same plane or trajectory, that has been described as backward movement, moving away from the target where the ball has been thrown and passing through the ball placement site or tee 7, where there will be no ball placed, and will reach the top of the backward swing that is shown in the FIG. 2, called in the jargon "backswing". From there on, the coming down movement to the target will start, going through tee 7 where the ball is placed or not according to the function chosen.

In fact, after such first swing and continuing with the method of the invention, device 1 will place a ball on tee 7, after detecting that the player has performed such first swing. Such ball will be placed according to the function chosen by the player, being these functions the ones already described in the method. Supposing that the player has chosen the function of practice with ratio 3:1 and "n" 1, the device, that has already detected the first swing, will detect the second swing that the player performs and only then, it will prepare and place a ball to be struck for the third swing. This is, as it can be seen, the ratio 3:1, that is, 3 swings and 1 ball. It is worth recalling that, as the method of the invention proposes, the player, since the beginning of his/her practice, performs continuous swings without stopping and without minding if the ball is or not on tee 7. As noted, when the device detects that a second swing has been performed, it prepares to place a ball on tee 7 in which such ball will be positioned on tee 7 before head 9 of golf club 8 reaches the point of tee 7 during the forward movement of the third swing, from the top position shown in the FIG. 2. The moment that the ball is positioned or placed will depend on the settlement of the positioning speed of the device. The way that the device of the invention detects a swing will be explained later with reference to the components of the device.

Continuing with the functioning or workings of the device 1 in the method of the invention, for the ratio 3:1, with "n" being 1 and "m" being three, the ball is placed for the third swing performed by the player, and the device will place a ball for every three swings. So, it will place a ball for the third, sixth swing, and so on, without the player interrupting or altering his/her swing.

To place the ball in a determined swing, for example, in the fifth swing, means that the device will place the ball on the tee 7 before the head 9 of the golf club reaches that fifth swing, to go through the tee 7.

As an example, it can be said that the ratio 1:1, 2:1 y 3:1 are kept when the player chooses to perform many continuous swings.

For example, if the player chooses to perform six (6) continuous swings with "n" being 0 and "m" being 1, with ratio 1:1, the first swing is without ball and the following five (5) swings are with ball.

If the player chooses to perform six (6) continuous swings with "n" being 1 and "m" being 1, with ratio 1:1, the first two swings are without ball and the following four (4) swings are with ball.

If "n" is 0 and "m" is 2, with ratio 2:1, the swings 1, 3, 5 and 7 are without ball and the swings 2, 4 and 6 are with ball.

If "n" is 1 and "m" is 2, with ratio 2:1, the swings 1, 2, 4 and 6 are without ball and the swings 3 and 5 are with ball.

In the case of choosing to perform only nine swings, if "n" is 0 and "m" is 3, with ratio 3:1, the swings 1, 3, 4, 6, 7 and 9 are without ball and the swings 2, 5 and 8 are with ball.

In the case of choosing to perform only nine swings, if "n" is 1 and "m" is 3, with ratio 3:1, the swings 1, 2, 4, 5, 7 and 8 are without ball and the swings 3, 6 and 9 are with ball. In either case, the player chooses the function and the quantity of swings to be performed. Summing up, the variable "n" gives the order of when the first ball is placed, while the variable "m" orders when the following balls are placed.

Lastly, the placement of balls can be commanded externally, for example, by a third person or teacher, that activates the device to place a ball, when the club head has past through the ball placement site towards the backward movement, when desired while the student is performing continuous swings. The device can be activated by any remote control, intelligent telephone or smart phone or similar to place the ball at the right moment.

Figure 2:
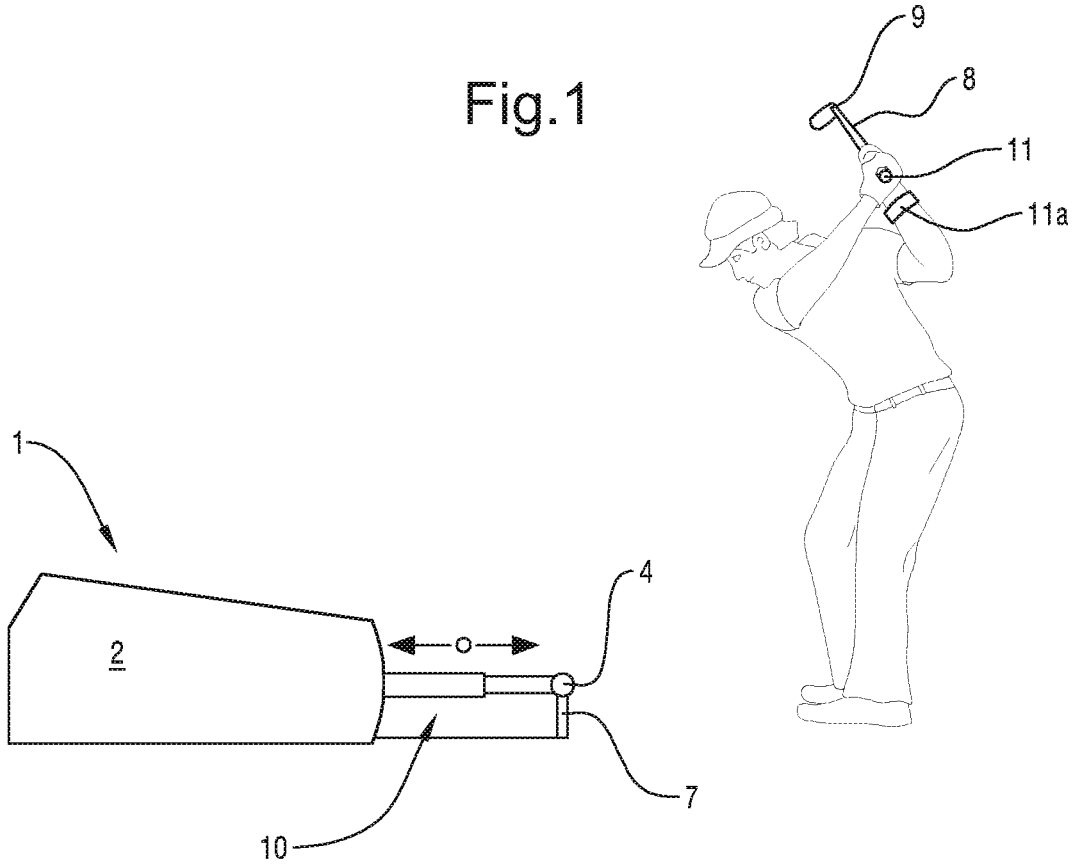
FIG. 2 shows a similar situation as FIG. 1 but the person has already performed the backward position of the movement or swing, that is to say, the person has already started the swing, that is to say, the moving away movement from the target has already taken place, being the target the place where it is intended to throw the ball and also moving away from the ball placement site or impact site, the backward movement is at its full range and from that point, the descending or forward movement starts heading towards the desired target and towards the ball that, according to what can be seen, it is being placed by the device of the invention on the tee or a support. It should be clarified that, although

To position the ball on tee 7, device 1 has at least one arm, indicated by general reference 10 in FIG. 2, that take balls from such container 3 and puts them one at a time in such ball placement site 7.

On the other hand, to detect the player's movement and the spatial position where the golf club is at 8, device 1 has means to follow the trajectory of the golf club through the space and has at least one signal transmitter placed in such golf club, and at least a control module 12 that includes the electronics to detect the movement of said at least one signal emitter or transmitter placed in the golf club. The so-called signal emitter or transmitter 11 is a set of sensor-emitter where the sensor can have an accelerometer and the emitter is a microcontroller with Bluetooth to establish the communication; a rechargeable battery is included. Both, the accelerometer and the microcontroller and battery are not Figure since they are a well-known set. For example, the accelerometer is of an electronic kind, as for example the accelerometer KX022-1020 brand name Kionix, currently used in cell phones, tablets, cameras, and etcetera. The accelerometer can detect the three spatial axes: X, Y and Z, so it is not important how it is located in relation with the line of the horizon of the ground, but what it does is to detect a spatial pattern in any of the combination of the measured axis. Physically, the sensor is placed with its plane XY in the same plane of the board and the board is perpendicular to the axis of the golf club 8.

This emitter 11 is preferably disposed in the "grip" of the golf club 8 and particularly, it is fixed, for example, through a removable screw, in the butt end of the grip of the club, as it is shown with the reference number 11.

The emitter 11, composed as a sensor-emitter set, can comprise a capsule with the necessary electronic components including a bolt or screw to be inserted and fixed in the butt end of the grip of the club, inside a hole already provided in all the known golf clubs; that is why, it is not illustrated in detail. Emitter 11 has a size of 2 mm×2 mm by 0.9 mm of height and does not have mobile parts, it is entirely electronic. Alternatively, emitter 11 can be placed in a bracelet on the player's wrist as it is shown with the reference 11*a* in FIG. 2.

Figure 5:
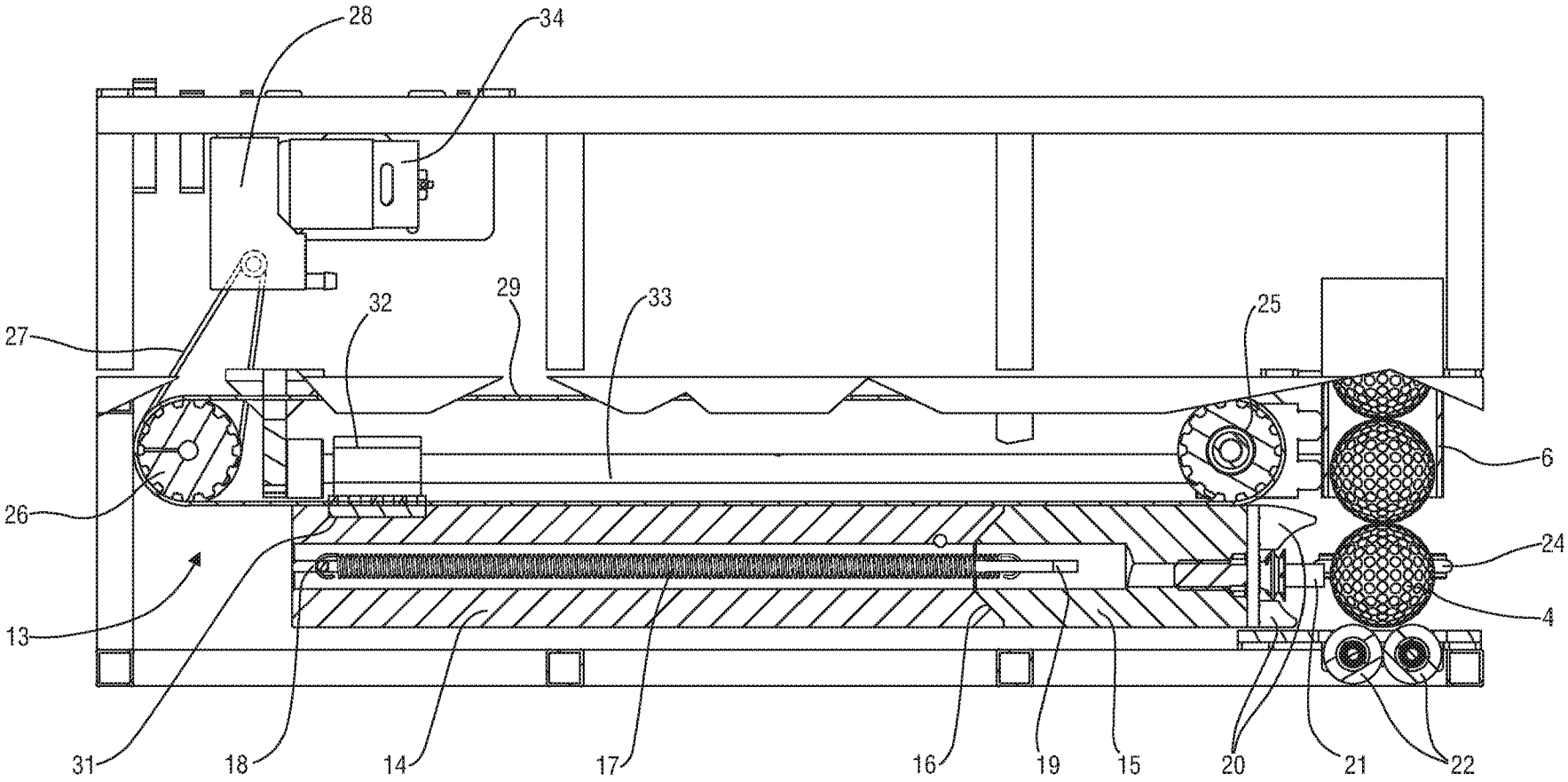
FIG. 5 shows an elevational view of the device of the invention, with a partial cut and also without the casing.

Control module 12 includes electronics capable of detecting the spatial position of emitter 11, and can be placed in any convenient place of the device. For example, in the place shown in FIGS. 3 and 4. Control module 12 comprises electronics with a circuit with a microcontroller that administers the reading of the sensor-emitter 11, for example, through Bluetooth, and it generates the output or outward signal to handle at least an impeller indicated with general reference 13 in FIGS. 3 to 5, to which it will be referred presently.

Additionally, the arm placer or ball placer, indicated with general reference 10, is combined with at least one driver or impeller 13 that is able of moving such arm and taking the balls from such container or holder and place them one at a time in such placement site or ball placement site 7. More specifically, arm 10 is composed of two portions of arm, one proximal portion 14 and one distal portion 15 that fit between themselves in a coupling 16 and they keep together by a spring 17 that has a proximal end attached to a fixation or fastening point 18 of arm portion 14 and a distal end attached to a fixation or fastening 19 of portion of the arm 15. The function of this coupling or attachment with spring will be explained shortly.

If there were any functional lack of coordination in the outward and inward arm mechanism 10 and if it happened that arm 10 was in the trajectory of golf club 8 when going through site 7, head 9 would impact on portion 15 without breaking arm 10 because the connection to the spring of portion 15 with portion 14 would make portion 15 give in and pivot in attachment 16, getting out of the axial position elastically and getting back to the attachment in the same way, impelled by spring 17. Alternatively, the player can replace manually portion 15 and, in this case, the device is on standby or hold until such portion is placed in its position.

Arm 10 has, in its proximal end, at least a pair of hands or claws 20 that will receive one ball at a time, when descending by gravity from tube 6. When arm 10 is activated outwards based on the information received from emitter 11 and control module 12 set, a flexible rubber suction cap 21, to which vacuum is transmitted through a small electric vacuum pump 34, makes contact with ball 4 and holds it by suction holding it until placing or positioning it on the impact site, ball placement site or tee 7. The suction cap can be one of the brands named piGrip® belonging to the firm PIAB.

More precisely, the balls are in tube 6 and when the arm goes backwards, the balls are freed and drop leaving the first one in the position of "stolen". Once the ball has come down from tube 6, it leans on a pair of rolls 22 and it is held by a pair of lateral retention wheels 23 that have a relatively cushioned periphery, for example, coated with a softer and more flexible material such as rubber 24. When the arm moves forward, the suction cap with the vacuum pump activated, approaches slowly until it makes contact with the ball, which gets firmly stuck, thanks to the vacuum effect, to the suction cap. Then the arm takes the ball to tee 7. Whereas arm 10 has been described as having two articulating parts, of fixed extension, it is clear that the arm can entail a different composition, as in a telescopic arm.

Arm 10 is driven to the position of placement of the ball, shown in FIG. 2, and again inwards of device 1 to its retracted position shown in FIGS. 1 and 3 to 5, by means of impeller mechanism 13 that comprises a pair of pulleys, a front pulley 25 and a back or rear pulley 26. Front pulley 25 is a driven one and rear pulley 26 is an impeller one, however these roles can be changed if desired because of a design issue. Back pulley 26 is driven through a pulley (not illustrated) that is attached to a strap or chain 27 that is driven by an engine 28 like a step to step engine to take advantage of the characteristic of open loop positioning, backspin/reverse pivot, speed control, acceleration, and etcetera. The engine is of a type NEMA 23 and has a torque of approximately of 2 Nm. Such engine 28 can be connected directly to such pulley 26 without the need of the chain or belt 27. To this effect, the only thing to be done is to position engine 28 next to pulley 26.

Assembled to such pulleys 25, 26, is a belt or strap 29 that attaches and runs around pulleys 25, 26.

A cart 30 is connected to belt 29 fixed firmly in 31 by any means, such as screws, rivets, and etcetera.

The cart 30 is taken forward and backwards by belt 29 to extend and retract arm 10 outwards and inwards of case or housing 2 of device 1. Given the speed that the arm should reach to place a ball 4 in site 7 and come back immediately, it may be necessary to count on an assembly that helps obtain a stable movement of all the set. In this way, cart 30 has bearings 32 that run along the corresponding guides rods 33 that can count with any anti-friction means placed on them.

Arm 10 will extend, taken outwards by cart 30 of housing 2 to put a ball 4 in tee 7 and it will retract immediately due to the action of control module 12 that incorporates all the necessary electronics to receive signals from emitter 11 and acts on such impeller mechanism 13 to move arm 10 so that it can take balls from such container or holder and puts them one at a time in such ball site placement site 7.

Control module 12 will operate according to its electronics as a detector that receives the signals from emitter 11 placed in the grip of the golf club 8. In this way, when the player is in front of the device or apparatus of the invention and this device is set to work, control module 12 detects the position of emitter 11. Control module 12 detects the movement of emitter positions 11 so it is able to determine which part of the swing the golf club is 8. For example, when a swing starts and finishes; and so it determines that a swing has ended and that the golf club is moving and staring another swing.

Another way of detecting one or more swings is to detect the times that head 9 of golf club 8 passes through the tee or ball placement site 7. Either ways, the number of swings performed by the player can be detected. The moment that control module activates or actuates arm 10 to put a ball on the tee or ball placement site 7 will depend, then, on the instructions adjusted or set to the control module.

Control module 12 can be programmed in a known way to register how a particular player's swing is. For example, the person can stand in front of the device of the invention and perform one, two or three swings so that the controller registers and acquires the user's swing way. Then, with the swing already registered, the electronics of the control module is able to detect when the swing has started and completed.

As it has been explained above, control module 12 can detect the number of swings done by the player and, according to the setting chosen, it determines the ratio to place the balls, that is, any ratios 3:1; 2:1 o 1:1, etcetera, for any case.

Preferably, control module 12, through impeller 13, that is engine 28, pulleys 25, 26 and belt or chain 29, makes arm 10 move to place the first ball in such ball placement site when the number of swings performed by the player is of "n+1", and makes such arm continue placing a ball at a time in such ball placement site every "m" player's movements or swings. Thus, with "n" being 0, and "m" being 3, with ratio 3:1, the device will activate to extend arm 10 and put ball 4 after the first swing. That is, in the second swing it will not place a ball but it will let the player perform the first swing without ball. Only then, it will place a ball before the player goes through tee 7 with the golf club during the second swing. If this is the function chosen, from then on, after such first ball, the device will always let the player execute two swings without ball and then in the third swing a ball will be placed so that it can be struck by the golf club. This allows the device of the invention to be set according to the desired function.

As regards the ways that the invention can be put into practice, the device may be disposed in different functions to supply balls for the student to put the method into practice according to the different functions or modes of exercise.

Before starting the practice, the player must enter the function to be used and the quantity of continuous swings that he/she wants to perform. This can be determined by the player, if he/she is training, or by the teacher.

For example, in the function of the ratio 3:1, the player performs three continuous swings and in the last swing, the third one, the ball is placed in the impact site.

In another function, for example, the ratio 2:1, the player performs two continuous swings and the ball is placed to be struck in the second swing. In all cases, the player can choose the quantity of swings he/she will perform with the chosen ratio. For example, if the quantity of swings chosen is ten, and the ratio chosen is 2:1, the first swing will be without ball and in the second swing the sequence of placing balls will start, being alternatively, one swing without ball and another one with it, until the ten swings are completed.

In another function, for example, the ratio 1:1, the player can decide the quantity of continuous swings to be done, for example, a minimum of two and a maximum of 10. After performing the first continuous swing, the ball is placed for the second continuous swing and from then on, the ball is being placed continuously for each swing until the swing number ten.

In another function, for example, the random function, the player can decide the quantity of continuous swing to be performed, for example, minimum three and maximum ten. Preferably, as it has been said, in the first continuous swing, as in all the other functions, there is no ball but from the second continuous swing a ball can be placed randomly, that is, the "random function", going on in this way, performing continuous swings, until the amount or quantity of swing are over.

In another function, with external command, the player can do the continuous exercise without taking into consideration the quantity of continuous swings, and a third person, for example, the teacher, through an external command, activates the device to place a ball when desired. However, the student will not know when the ball will appear and be placed on the tee 7.

In another function, the player may activate the device to place a ball through a conventional application.

As it has been extensively explained above, with the continuous exercise in the function of ratio 3:1, the player develops a functional psychology and a technically strong swing that makes him/her transfer it to the golf course. This is thanks to the two continuous swings without ball and a third continuous swing with ball, the player experiences a strong internal stimulus that takes him to perform a purer and more intense swing consistently. This should be, preferably, the starting point for the majority of the amateur players.

The change of the functions of use of the device of the invention allows the learning process to be maximized in such a way that not only the person develops the swing but also he/she can transfer it easier to the golf course.

The player, to practice and consolidate the learning process with the first function, that is, three continuous swings, where two swings are done without ball and the third one is with ball, is ready, from there on, to pass to a second function until the fourth function is completed.

To get into the benefits of the functions, by advancing to the next function, as ratio 3:1 advancing to 2:1, the player takes a step forward with the method and with his/her improvement. As the player gradually and strategically practices with the functions of the device, he/she performs a high quality stimulus and a high quantity (duration) stimulus operating from the psychology "Kinesthetic-Swing Focus" while facing gradual and bigger challenges and/or stress, for example, continuously striking one ball after another. In other terms, what the player develops with the continuous exercise and its functions is a functional behavior and an emotional relationship with the ball. A relationship where the ball stops being "an external visual stimulus that induces an internal conflict", this being the order to hit at the ball, and the ball simply is or starts being "an external object that rests in space". With this the player's order is to swing through the ball and this is applied to the one definite striking swing. Basically said, the player's inner conflictive relationship with the ball is transformed to an effective and functional inner agreement.

Constantly accessing the "Kinesthetic-Swing Focus" when the challenge increases is vital for transferring an effective swing on to the course, a swing without involuntary movements. Once the functional motor and psychological fundamentals are developed, in order to achieve an effective transference to the course, it is necessary for such fundamentals to adapt to the present scenario, and for this, the player must have developed the "Kinesthetic-Swing Focus". This must take place, without exception, in order to transfer the swing to the course, since the player must not only be connected or attached to his/her kinesthesia but also anchored to it. Applying the necessary sensations for improving or transferring, not only the swing desired which is of internal focus, but also the contact, result and target desired which is external focus, the player needs to become a sensitive and/or kinesthetic player, in other words a player anchored to his/her kinesthesia. This is to say, to develop and/or perform effectively the swing, contact, result and/or target on the course, it is always done through the player's kinesthesia. Being connected kinesthetically is beneficial for not only being more present during the strike, but also for performing the best movement that the player has, since the more attached to the kinesthetic swing the less involuntary movements are. The different functions of the device serve as steps for the player to, improve his/her swing in more complex ways later on and to get mentally strong for the different scenarios that he/she may face on the course. The higher the need for the player to access the "Kinesthetic-Swing Focus" the bigger the ratio is, and the lower the need to access it the smaller the ratio is; because the player already accesses on his/her own. The first four functions, the ratios 3:1, 2:1, 1:1 and the random one, being in this order or not, are to face gradual challenges, to develop a pure swing sensation, an intense swing sensation, and to operate psychologically from "Kinesthetic-Swing Focus". However, for a gradual and strategic practice it is preferable that the order of these functions be 3:1; random; 2:1 and 1:1.

Concluding, it can be claimed that one main advantage of the method of the present invention is that it is based on the person's or player's internal stimulus, reducing and/or eliminating any external stimuli. Even more, when an amateur player performs continuous swings, the internal stimulus that results in a purer and high intensity swing sensation, is higher or greater than the external stimulus generated by the presence of the ball when struck, resulting in an effective behavior and/or swing. This effective behavior and/or swing is then transferred to one definitive swing striking the ball.

For the player that does not have a pure and an intense swing sensation on a regular swing, it is important that he/she keeps their feet in the same starting place so that he/she can only focus on the swing. This means that the focus is on the internal aspect of the person without adapting to the external aspect, that is, the ball.

With the method and device of the invention, the player, consistently goes, consciously or unconsciously, beyond his present movement and ability.

The exercise through the method of the invention provides two relevant areas of developments: a cognitive and motor one.

I claim:

1. A device for the instruction, teaching and training of a golf swing to be performed by a person using a golf club to strike a golf ball, where the golf club has a head to strike the ball when the ball is placed in a ball placement site and where the golf swing comprises at least a backward movement where the golf club moves away from the ball placement site and a forward movement towards the ball placement site to strike the ball at the ball placement site, wherein the device comprises:

(i) at least one arm that holds a plurality of balls and places the balls one at a time in such ball placement site, (ii) at least an impeller to move said arm and causes the arm to grab said balls and to place the balls one at a time in said ball placement site, (iii) at least one control module that detects movement of said person and his/her golf club and activates such impeller to move said at least one arm so that the impeller causes the at least one arm to grab said balls and to place said balls one at a time in said ball placement site according to the detected movement, (iv) at least one signal emitter disposable on at least one of said person and golf club, and wherein the at least one control module is capable of detecting the movement of said at least one signal emitter and detecting a number of swings performed by the person, and said at least one arm is movable between a retracted position inside the device and an extended position where said at least one arm places the first ball in said ball placement site when the number of swings performed by the person is "n+1", said at least one arm continues placing one ball at a time in said ball placement after a number of "m" swings done by the person.

2. The device of claim 1, further comprising a balls container from where such balls are discharged towards said at least one arm that takes balls from said balls container and places the balls one at a time in said ball placement site.

3. The device of claim 1, wherein "n" is at least 0 and "m" is at least 1.

4. The device of claim 1, wherein at least one of "n" and "m" is random.

5. The device of claim 1, wherein said at least one signal emitter is disposable in the golf club and the at least one signal emitter includes an accelerometer which is removably fixable in a grip of the club.

6. The device of claim 1, wherein said at least one control module includes an electronic signal detector for detecting signals from said emitter and for actuating said impeller.

7. The device of claim 1, wherein said at least one arm comprises a proximal portion and a distal portion that are coupled to each other by a spring that has a proximal end fixed to a proximal portion of the at least one arm and a distal end fixed to a distal portion of the at least one arm.

8. The device of claim 7, wherein said at least one arm includes at least a suction cup connected to a vacuum pump to hold one ball that comes from said balls container and to take the ball and to drop the ball in said ball placement site.

9. The device of claim 8, wherein said at least one arm includes supportive hands for retaining a ball by said at least one suction cup.

10. The device of claim 1, wherein said impeller comprises at least a front pulley and a rear pulley, wherein at least one of said pulleys is driven by an engine and a band is coupled around said pulleys, with a cart being fixed to said band so as to move with the band forward and backwards, and said at least one arm being fixed to such cart to move between such extended and retracted positions.

* * * * *